US010836019B2

(12) United States Patent
Matsushita et al.

(10) Patent No.: US 10,836,019 B2
(45) Date of Patent: Nov. 17, 2020

(54) WORK MACHINE

(71) Applicant: HITACHI KOKI CO., LTD., Tokyo (JP)

(72) Inventors: Akira Matsushita, Ibaraki (JP); Takuhiro Murakami, Ibaraki (JP); Tomomasa Nishikawa, Ibaraki (JP); Junichi Toukairin, Ibaraki (JP); Shota Takeuchi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 303 days.

(21) Appl. No.: 15/547,197

(22) PCT Filed: Jan. 8, 2016

(86) PCT No.: PCT/JP2016/050503
§ 371 (c)(1),
(2) Date: Jul. 28, 2017

(87) PCT Pub. No.: WO2016/121463
PCT Pub. Date: Aug. 4, 2016

(65) Prior Publication Data

US 2018/0001444 A1 Jan. 4, 2018

(30) Foreign Application Priority Data

Jan. 30, 2015 (JP) ..... 2015-017874
Jul. 15, 2015 (JP) ..... 2015-141042

(51) Int. Cl.
*B25B 21/02* (2006.01)
*B25F 5/02* (2006.01)
(Continued)

(52) U.S. Cl.
CPC ..... *B25B 21/02* (2013.01); *B25B 23/18* (2013.01); *B25F 5/00* (2013.01); *B25F 5/008* (2013.01); *B25F 5/02* (2013.01)

(58) Field of Classification Search
CPC ..... B25B 21/02; B25B 23/18; B25F 5/008; B25F 5/02
(Continued)

(56) References Cited

U.S. PATENT DOCUMENTS 8,810,085 B2 * 8/2014 Matsunaga ..... B25F 5/008 310/50
9,126,320 B2 * 9/2015 Shinma ..... B25D 17/20
(Continued)

FOREIGN PATENT DOCUMENTS

CN 101636250 A 1/2010
CN 102596512 A 7/2012
(Continued)

OTHER PUBLICATIONS

Office Action issued in corresponding Japanese Patent Application No. 2016-571905, dated Jun. 26, 2018.
(Continued)

*Primary Examiner* — Dariush Seif
(74) *Attorney, Agent, or Firm* — McDermott Will & Emery LLP

(57) ABSTRACT

In order to provide an impact work machine capable of preventing oil leakage and cooling a power transmission apparatus, an impact work machine transmitting power of an electric motor 16 including an output shaft extending in an axis A1 direction to an anvil includes: a housing including a motor case accommodating the electric motor, and a grip extending from the motor case; a speed reducer and an impact mechanism 96 each transmitting power of the electric motor to the anvil; a hammer case located forward of the
(Continued)

motor case and nonrotatable relative to the motor case; an extension portion provided on the housing and extending from the motor case toward the hammer case so as to cover at least part of the hammer case; and a passage provided between the hammer case and the extension portion and through which air passes.

10 Claims, 19 Drawing Sheets

(51) Int. Cl.
*B25B 23/18* (2006.01)
*B25F 5/00* (2006.01)

(58) Field of Classification Search
USPC ..... 173/216
See application file for complete search history.

(56) References Cited

U.S. PATENT DOCUMENTS

2004/0124721 A1* 7/2004 Pfisterer ..... B25D 17/20 310/51
2005/0153636 A1* 7/2005 Numata ..... B24B 23/028 451/358
2010/0244592 A1* 9/2010 Oomori ..... B25F 5/008 310/50
2010/0270877 A1* 10/2010 Esenwein ..... B24B 23/028 310/62
2010/0277897 A1* 11/2010 Hecht ..... B25B 21/00 362/119
2011/0148227 A1* 6/2011 Schuele ..... B25F 5/008 310/50
2012/0152504 A1* 6/2012 Luettich ..... B25F 5/008 165/122
2012/0319509 A1* 12/2012 Kishima ..... B23B 45/02 310/50
2013/0028674 A1* 1/2013 Okubo ..... B23B 49/00 408/16
2013/0255982 A1* 10/2013 Takahashi ..... B25B 21/02 173/47
2014/0371018 A1* 12/2014 Ito ..... B25F 5/008 475/149
2016/0229045 A1* 8/2016 Hashimoto ..... B25D 17/043

FOREIGN PATENT DOCUMENTS

CN 102834228 A 12/2012
CN 104227076 A 12/2014
GB 2314795 A 1/1998
JP 2006-297487 A 11/2006
JP 4541958 B2 9/2010
JP 2010-284734 A 12/2010
JP 2011-218496 A 11/2011
JP 2013-000834 A 1/2013
JP 2014-240114 A 12/2014
WO 2011/129455 A1 10/2011

OTHER PUBLICATIONS

Chinese Office Action issued in corresponding Chinese Patent Application No. 201680007834.2, dated Sep. 3, 2019, with English translation.
International Search Report issued in Application No. PCT/JP2016/050503 dated Mar. 29, 2016, with English translation.
Japanese Office Action issued in corresponding Japanese Patent Application No. 2016-571905, dated Oct. 9, 2018, with English Translation.
Supplementary European Search Report issued in European Patent Application No. 16743067.7, dated Oct. 2, 2018.

* cited by examiner

WORK MACHINE

RELATED APPLICATIONS

This application is the U.S. National Phase under 35 U.S.C. § 371 of International Application No. PCT/JP2016/050503, filed on Jan. 8, 2016, which in turn claims the benefit of Japanese Application No. 2015-017874, filed on Jan. 30,2015, and Japanese Application No. 2015-141042, filed on Jul. 15, 2015, the disclosures of which are incorporated by reference herein.

TECHNICAL FIELD

The present invention relates to a work machine transmitting power of a motor to a tool support member.

BACKGROUND ART

Conventionally, a work machine transmitting power of a motor to a tool support member has been known, and an example of the work machine is described in Patent Document 1. The work machine described in Patent Document 1 is an impact driver, and the impact driver includes a housing, a motor and a planetary gear mechanism which are accommodated in the housing, a unit case assembled to the housing, an oil unit accommodated in the unit case, and a chuck sleeve provided at a spindle of the oil unit and serving as a tool support member. In addition, the impact driver further includes a cooling fan fixed to an output shaft of the motor, a backward intake port provided in the housing, a forward intake port provided in the unit case, and an exhaust port provided in the housing.

The cooling fan of the impact driver described in Patent Document 1 rotates together with the output shaft of the motor, and air outside the housing is sucked into the housing through the backward intake port to cool the motor. In addition, air outside the housing is sucked into the oil unit through the forward intake port to cool the oil unit. Then, the air sucked into the housing and the oil unit is discharged to the outside of the housing through the exhaust port. The oil unit rotates inside the unit case and is filled with oil.

RELATED ART DOCUMENT

Patent Document

Patent Document 1: Japanese Patent No. 4541958

SUMMARY OF THE INVENTION

Problems to be Solved by the Invention

In the work machine described in Patent Document 1, an air path is formed between the rotating oil unit and the unit case accommodating the oil unit. Therefore, it is necessary to provide the unit case with an opening portion taking air outside the housing into the unit case. Therefore, leakage of oil or the like through the opening portion may be possibly caused, and in this respect, there is room for improvement.

In addition, from viewpoints of portability, workability, and the like, size reduction of the work machine is required. However, in the work machine described in Patent Document 1, a cooling passage through which air flows is provided on a lateral side of the oil unit, and dimensions of the work machine in a width direction is large. Therefore, there is room for improvement in order to reduce the size of the work machine.

In addition, in general, a work machine is provided with an illumination apparatus illuminating a forward area of the tool support member. Many of the illumination apparatuses have structures of emitting light by using electric power, and a temperature of the illumination apparatus rises. However, a technique of cooling the illumination apparatus is not described in the work machine described in Patent Document 1, and there is room for improvement.

An object of the present invention is to provide a work machine capable of preventing oil leakage and cooling a power transmission apparatus. In addition, an object of the present invention is to provide a work machine capable of cooling a power transmission apparatus without increasing the size of the work machine. Furthermore, an object of the present invention is to provide a work machine capable of cooling an illumination apparatus.

Means for Solving the Problems

A work machine according to one embodiment is a work machine transmitting power of a motor including an output shaft extending in a front-back direction to a tool support member, and the work machine includes: a housing including a motor case accommodating the motor, and a grip extending from the motor case; a power transmission apparatus transmitting power, of the motor to the tool support member; a case located forward of the motor case, nonrotatable relative to the motor case, and accommodating the power transmission apparatus; an extension portion provided on the housing and extending from the motor case toward the case so as to cover at least part of the case; and a cooling passage provided between the case and the extension portion and through which air passes.

A work machine according to another embodiment is a work machine transmitting power of a motor including an output shaft extending in a front-back direction to a tool support member. The work machine includes: a housing including a motor case accommodating the motor, and a grip extending from the motor case; a switch provided on the grip and switching rotation and stop of the motor; a power transmission apparatus transmitting power of the motor to the tool support member; and a case supported forward, of the motor case and accommodating the power transmission apparatus. The housing includes an extension portion extending from the motor case to a position above the switch so as to cover a lower side of the case. A cooling passage through which air passes is provided between the case and the extension portion.

A work machine according to another embodiment is a work machine transmitting power of a motor to a tool support member, and the work machine includes: a power transmission apparatus transmitting power of the motor to the tool support member; an illumination apparatus arranged outside the power transmission apparatus in a radial direction an axis that is a rotation center of the power transmission apparatus, and illuminating a forward area of the tool support member; and a cooling passage formed between the power transmission apparatus and the illumination apparatus in the radial direction and through which air passes.

A work machine according to another embodiment is a work machine transmitting power of a motor including an output shaft extending in a front-back direction to a tool support member, and the work machine includes: a power transmission apparatus transmitting power of the motor to the tool support member; a case accommodating the power transmission apparatus; a housing accommodating the motor and the power transmission apparatus and supporting the case such that the case is nonrotatable; and an exhaust port through which air in the housing is discharged outside the housing. The exhaust port is arranged between the power transmission apparatus and a front end of the tool support member in a direction of an axis that is a rotation center of the tool support member, and the exhaust port is arranged between the axis and an end portion of the housing in a front view of the housing.

A work machine according to another embodiment is a work machine transmitting power of a motor including an output shaft extending in a front-back direction to a tool support member, and the work machine includes: a power transmission apparatus transmitting power of the motor to the tool support member; a case accommodating the power transmission apparatus; a housing accommodating the motor and the case and supporting the case such that the case is nonrotatable; a protector covering a portion of the case, the portion being exposed from the housing; and an exhaust port provided in the protector and through which air in the housing is discharged outside the housing.

A work machine according to another embodiment is a work machine transmitting power of a motor including an output shaft extending in a front-back direction to a tool support member, and the work machine includes: a power transmission apparatus transmitting power of the motor to the tool support member; a case accommodating the power transmission apparatus; a housing accommodating the motor and the case and supporting the case such that the case is nonrotatable; and a passage formed between the housing and the case and communicating with inside and outside of the housing.

Effects of the Invention

The work machine according to one embodiment can prevent oil leakage and cool the power transmission apparatus.

In addition, the work machine according to another embodiment can cool the power transmission apparatus without increasing the size of the work machine.

Furthermore, the work machine according to another embodiment can cool the illumination apparatus.

BRIEF DESCRIPTIONS OF THE DRAWINGS

Figure 12:
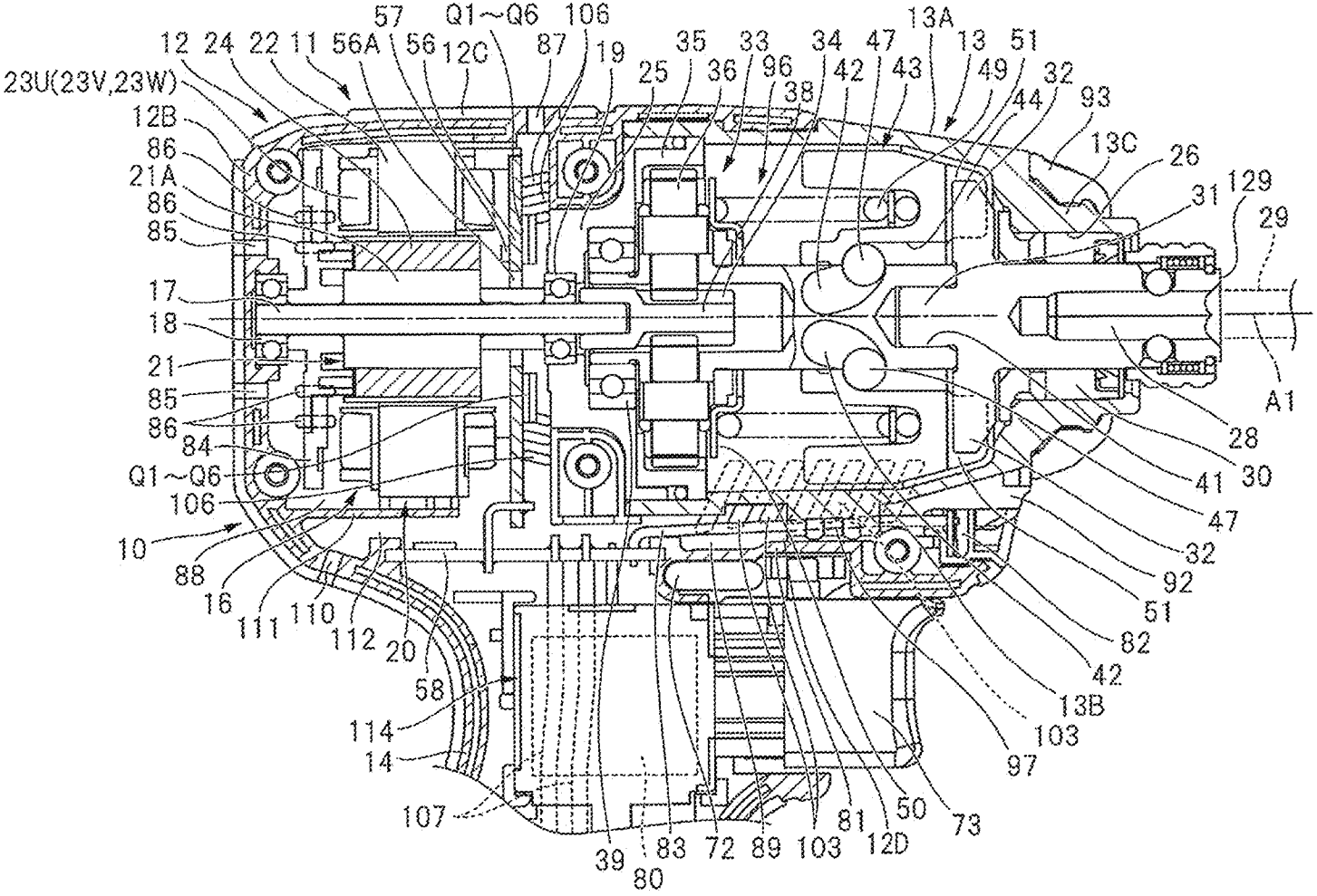
Figure 13:
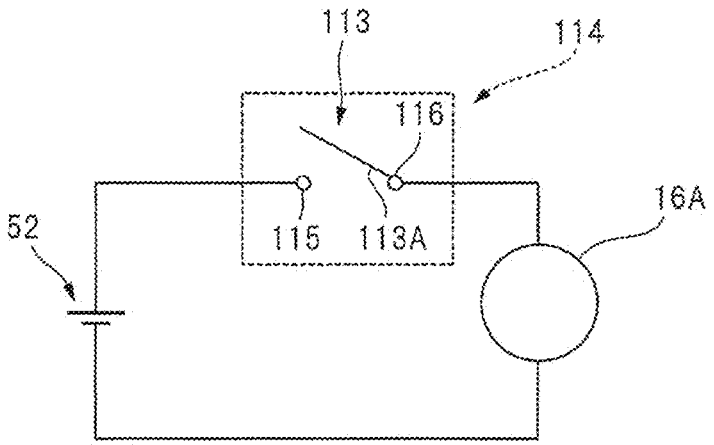
Figure 14:
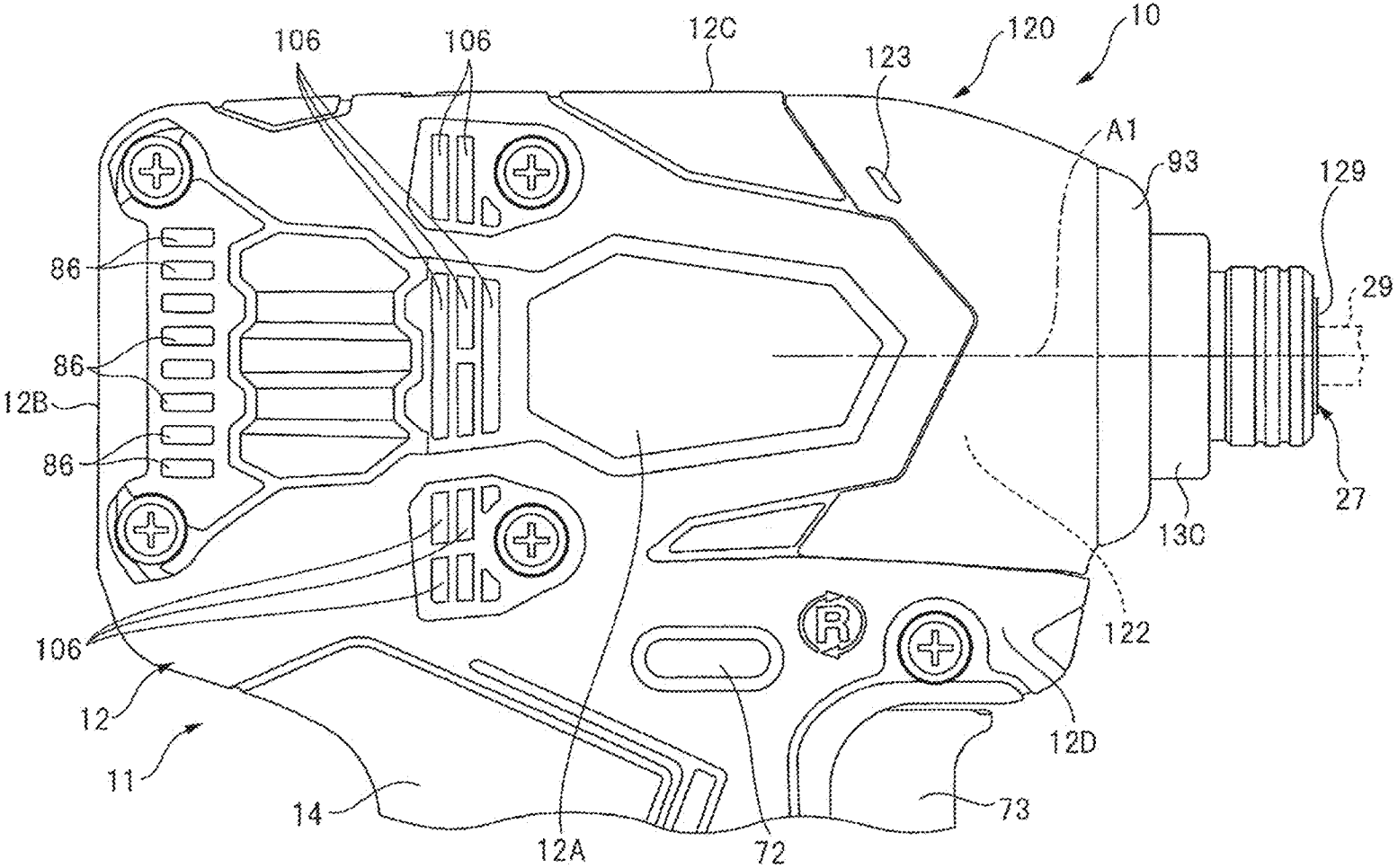
Figure 15:
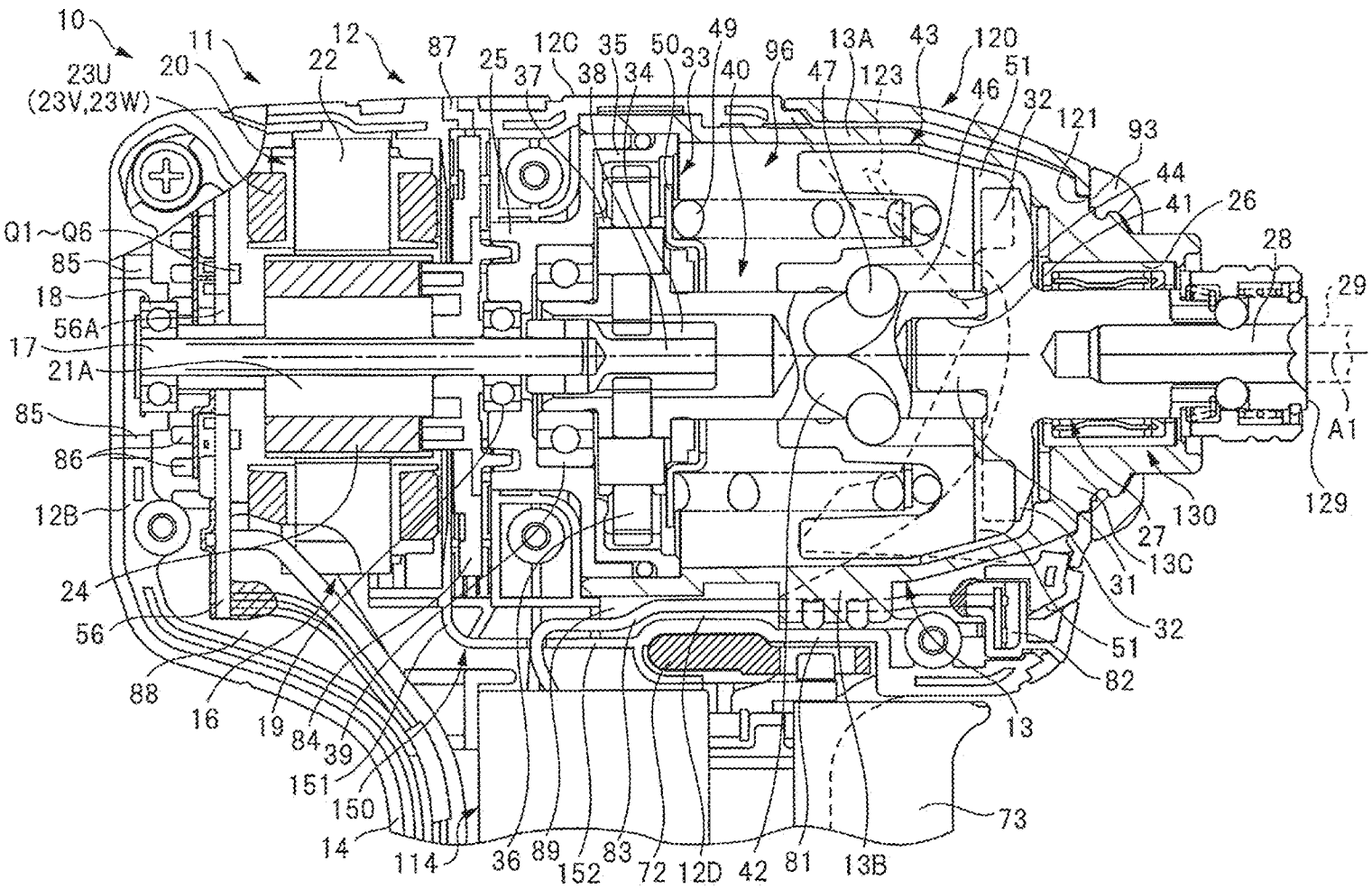
Figure 16:
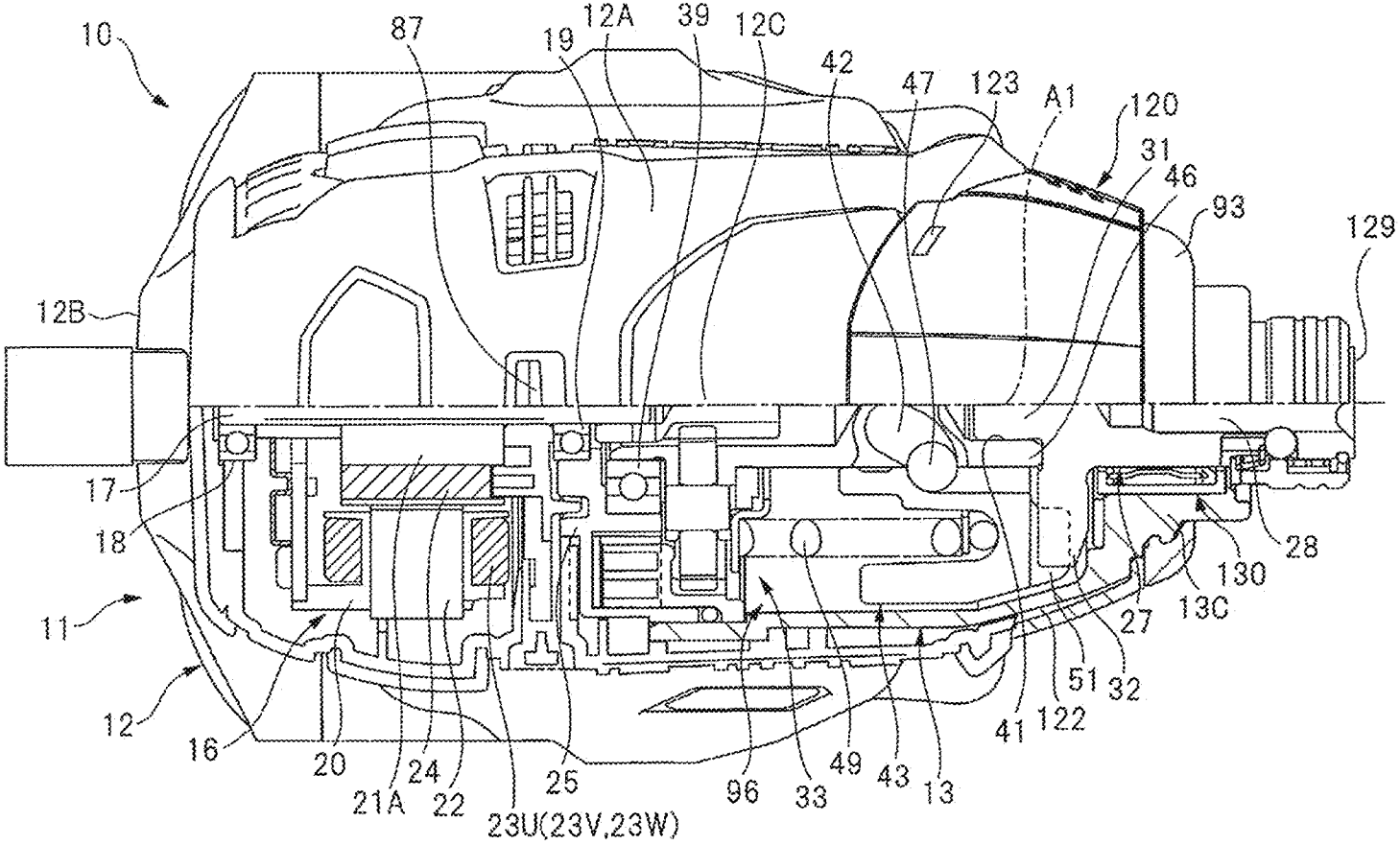
Figure 17:
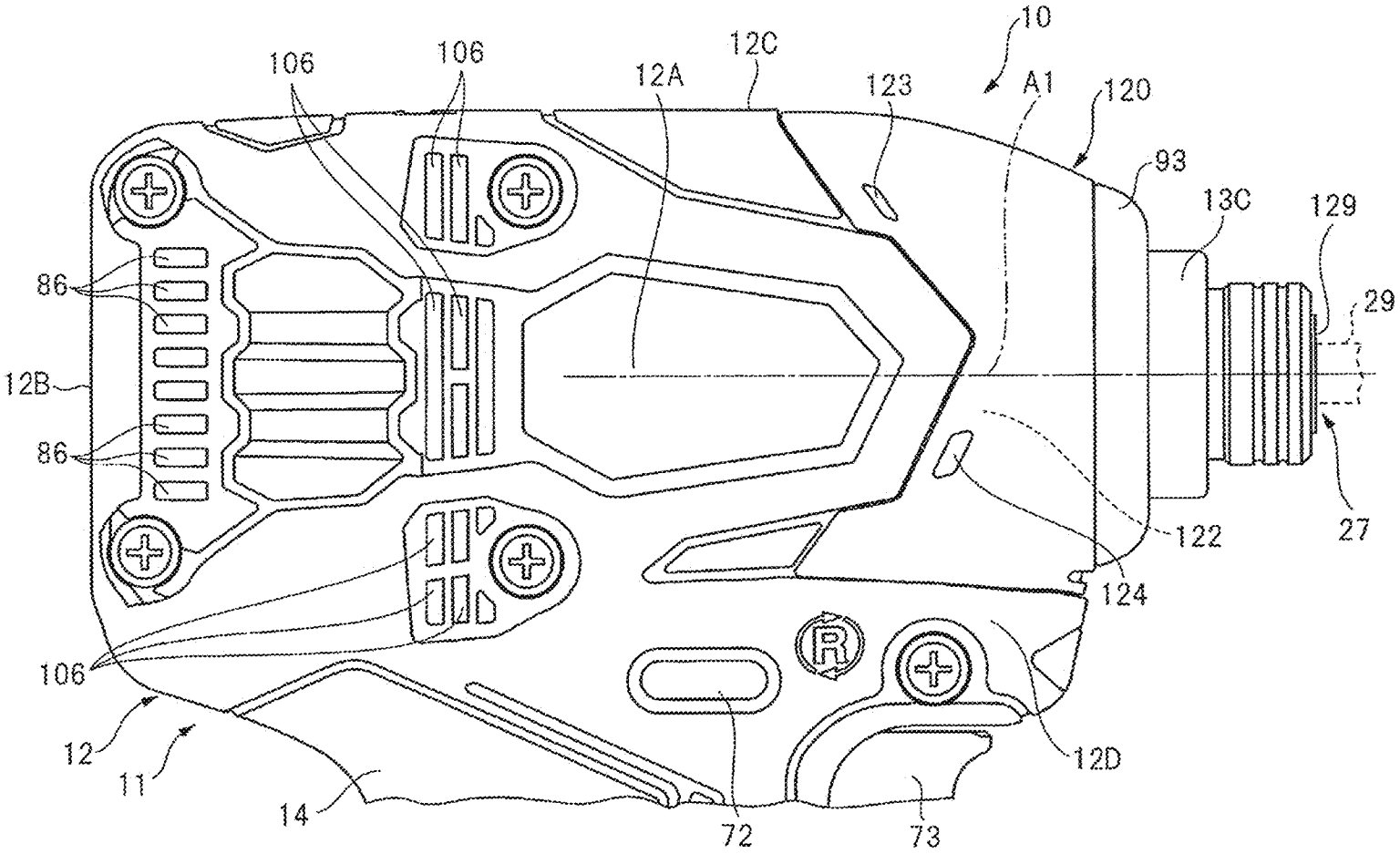
Figure 18:
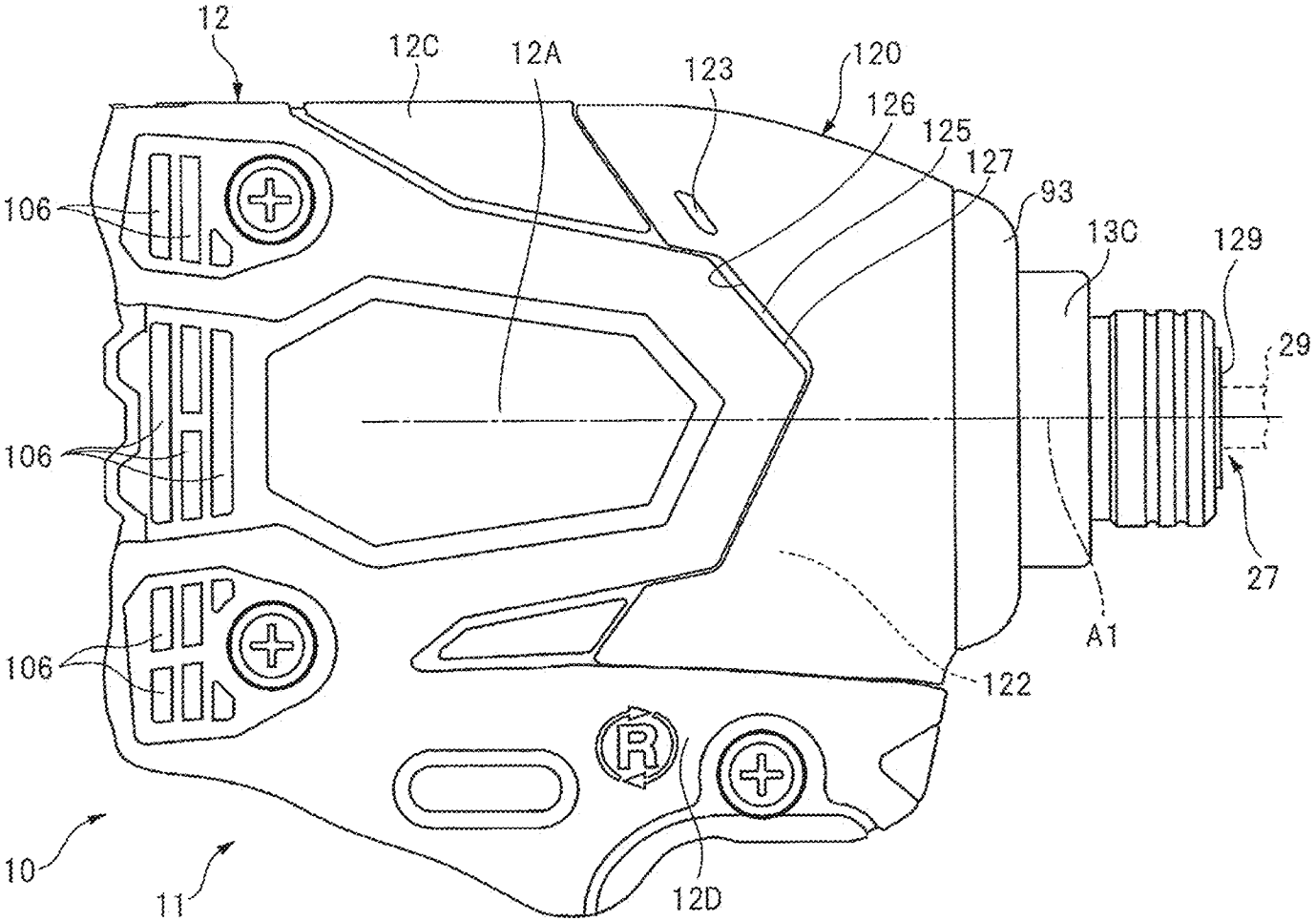
Figure 19:
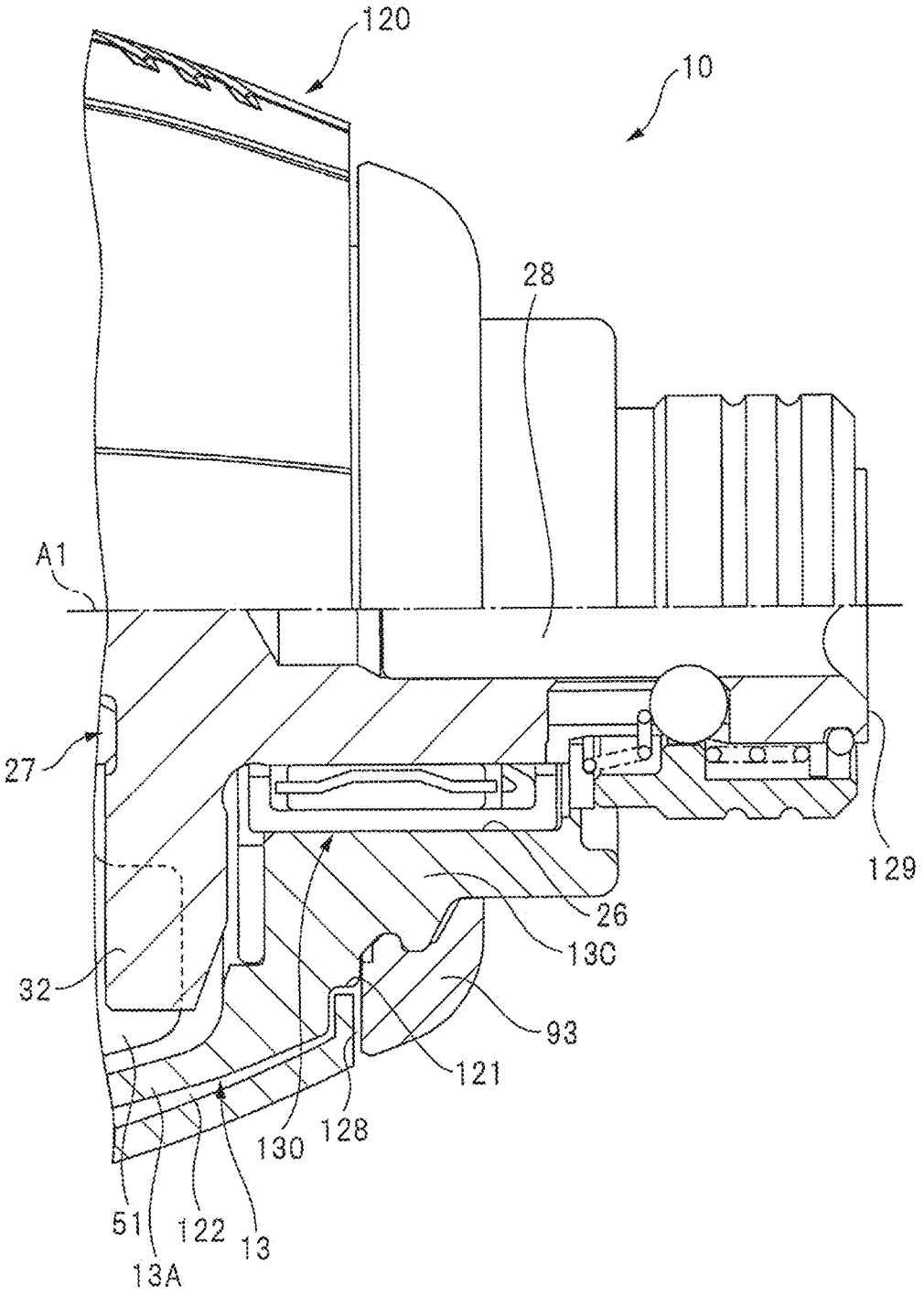

FIG. 12 a cross-sectional view illustrating still further structural example of the impact work machine according to the present invention;

FIG. 13 is a block diagram illustrating a control system using an electric motor with a brush as a motor of the impact work machine according to the present invention;

FIG. 14 is a front view illustrating a structural example of the impact work machine according to the present invention;

FIG. 15 is a front cross-sectional view of the impact work machine of FIG. 14;

FIG. 16 is a front cross-sectional view of the impact work machine of FIG. 14;

FIG. 17 is a front view illustrating another structural example of the impact work machine according to the present invention;

FIG. 18 is a partial front view illustrating still another structural example of the impact work machine according to the present invention; and FIG. 19 is a front view illustrating yet another structural example of the impact work machine according to the present invention.

DETAILED DESCRIPTION OF PREFERRED EMBODIMENTS

Figure 1:
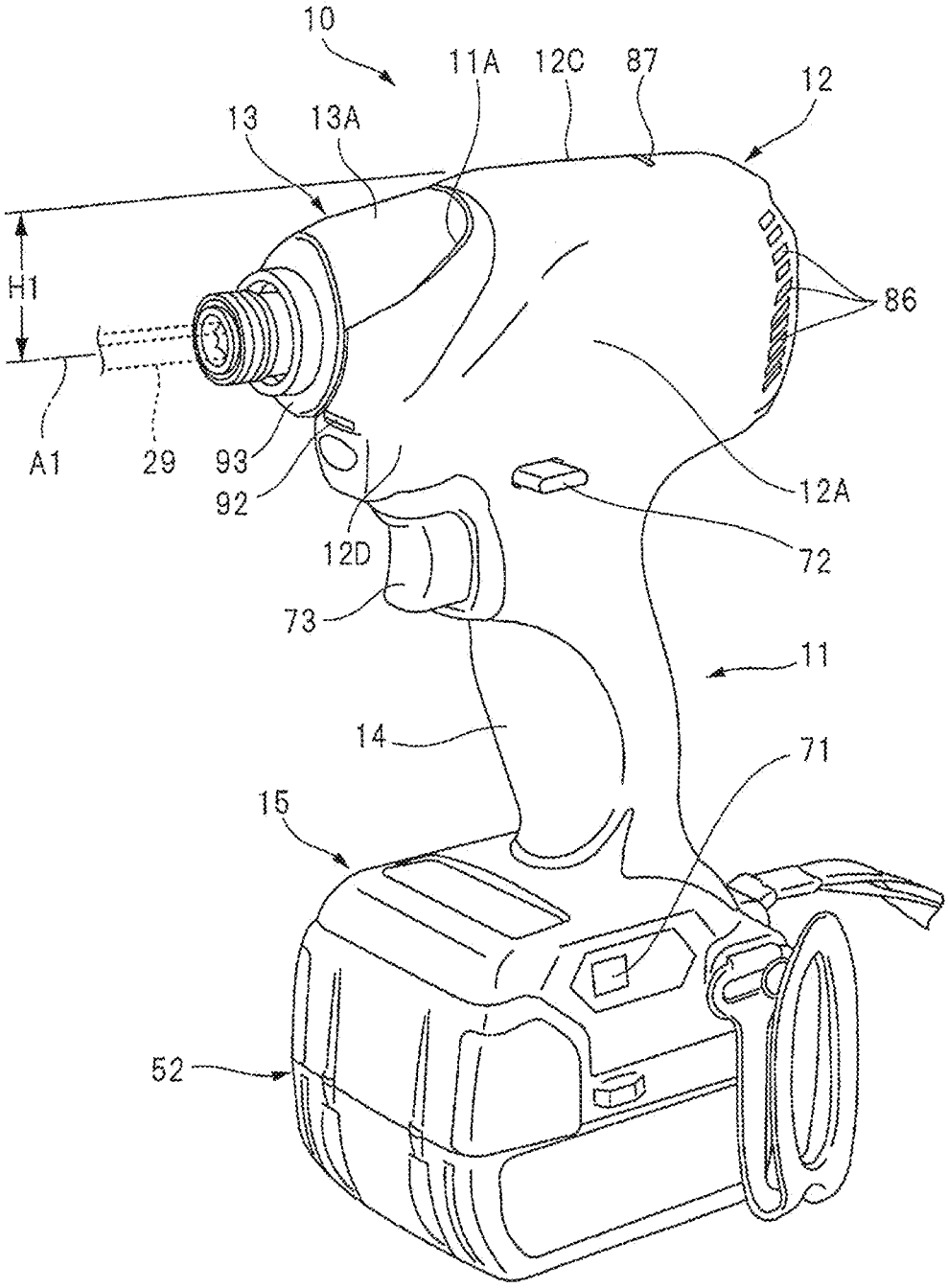
FIG. 1 is a perspective view illustrating an impact work machine according to the present invention.
Figure 2:
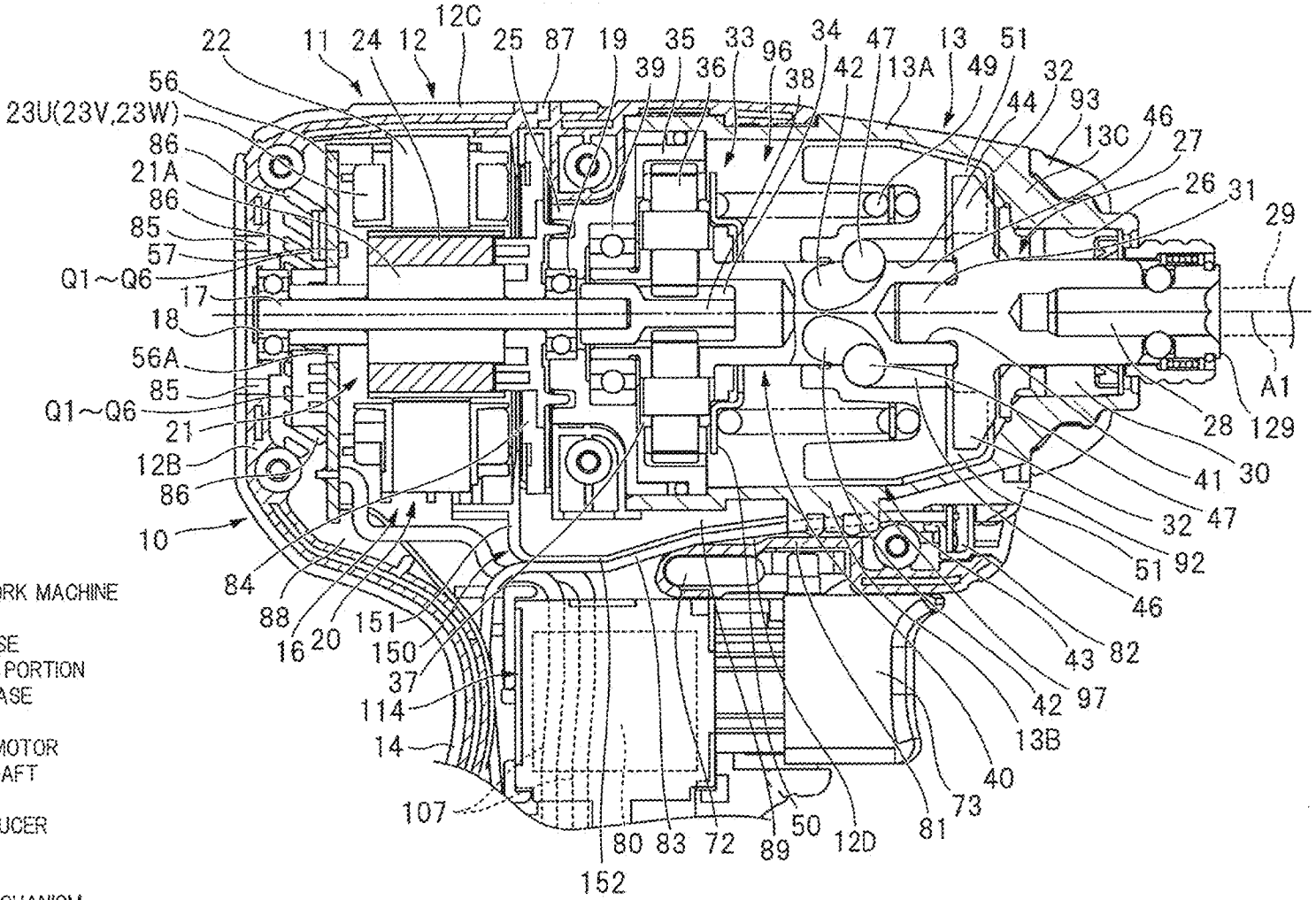
FIG. 2 is a front cross-sectional view illustrating a structural example of the impact work machine according to the present invention.

Hereinafter, one embodiment of the present invention will be described in detail with reference to the drawings. An impact work machine 10 illustrated in FIGS. 1 and 2 is an impact driver used for work of fixing an article to a mating member and rotating and fastening a screw member, and work of loosening a screw member. The impact work machine 10 has a hollow housing 11, and the housing 11 includes a hollow motor case 12 and a hollow grip 14 continuous with the motor case 12. The motor case 12 is made of synthetic resin and includes a cylindrical portion 12A and a wall 12B provided at an end in a direction along an axis A1 passing through the cylindrical portion 12A. The direction along the axis A1 is a front-back direction of the motor case 12.

A hammer case 13 is provided in the cylindrical portion 12A. The grip 14 is continuous with the cylindrical portion 12A and extends in a radial direction around the axis A1. The grip 14A is provided with a trigger 73 and an attachment portion 15 The trigger 73 is arranged between the motor case 12 and the attachment portion 15 in the radial direction around the axis A1. The motor case 12 includes an extension portion 12D extending forward from the cylindrical portion 12A in the direction along the axis A1. The extension portion 12D is extended toward the hammer case 13. The extension portion 12D is partially provided in a circumferential direction around the axis A1. A range other than the extension portion 12D in the circumferential direction of the motor case 12 constitutes a cutout portion 11A. The extension portion 12D is located above the trigger 73 in the radial direction of the motor case 12 around the axis A1. A wall 81 is provided inside the extension portion 12D.

Furthermore, inside the motor case 12, that is, inside a motor accommodation chamber 88, an electric motor 16 provided. The electric motor 16 includes a stator 20 serving as an armature, and a rotor 21 serving as a field system. The stator 20 is provided inside the motor case 12 such that the stator 20 does not rotate. The stator 20 includes a stator core 22, and three coils 23U, 23V, and 23W which are wound around the stator core 22 and to which a current is supplied. The rotor 21 includes a rotor core 21A fixed to an output shaft 17, and a plurality of permanent magnets 24 arranged along a rotation direction of the rotor core 21A. The output shaft 17 is rotatably supported by two bearings 18 and 19. The plurality of permanent magnets 24 different in polarity are alternately arranged along the rotation direction. The electric motor 16 is a brushless motor, which does not use a brush through which a current flows. The electric motor 15 can switch the rotation direction of the rotor 21 by switching a direction of a current supplied to each of the three coils 23U, 23V, and 23W.

In the motor case 12, a partition 25 separating the motor accommodation chamber 88 and the hammer case 13 is provided. The partition 25 is formed into a ring shape. The partition 25 does not rotate relative to the motor case 12. The partition 25 supports the bearing 19, and the motor case 12 supports the bearing 18. The output shaft 17 can rotate around the axis A1. The output shaft 17, a spindle 40, and an anvil 27 are concentrically arranged around the axis A1. That is, the axis A1 is the rotation center of the output shaft 17, the spindle 40, and the anvil 27.

The hammer case 13 is made of a metal, and the hammer case 13 has a cylindrical shape. An outer peripheral surface of the hammer case 13 is covered with the extension portion 12D of the motor case 12. The motor case 12 has a cylindrical shape, and the wall 12B is provided at the end in the direction along the axis A1. The cutout 11A is formed on a side opposite to a location where the wall 12B is provided in the direction along the axis A1. A portion 13A which is part of the hammer case 13 in the circumferential direction is exposed to the outside of the motor case 12 from the cutout portion 11A. The portion 13A is located opposite to the grip 14 in the circumferential direction around the axis A1. Furthermore, a nose cover 93 covering a front end 13C of the hammer case 13 is provided. The nose cover 93 is made of a synthetic rubber and formed into a ring shape.

A shaft hole 26 is provided at the front end 13C of the hammer case 13. The shaft hole 26 is provided at the front end 13C, and the front end 13C has a cylindrical shape. The anvil 27 rotatably supported by the cylindrical sleeve 30 is arranged in the shaft hole 26. The anvil 27 can rotate around the axis A1. In addition, the anvil 27 is provided to extend from the inside of the hammer case 13 to the outside of the housing 11, and the anvil 27 is provided with a tool holding hole 28. A front end 129 of the anvil 27 is arranged outside the hammer case 13. The tool holding hole 28 is opened outside the housing 11. A driver bit 29 serving as a work tool is attached to and detached from the tool holding hole 28.

In addition, a support shaft 31 is provided at the anvil 27 such that the support shaft 31 is concentric with the tool holding hole 28. The support shaft 31 is arranged inside the hammer case 13. Furthermore, a plurality of projections 32 are provided at locations on the outer peripheral surface of the anvil 27, the locations being inside the hammer case 13. A rotation stopper 97 is provided on the outer peripheral surface of the hammer case 13. The rotation stopper 97 is provided at one location in the circumferential direction of the hammer case 13. The rotation stopper 97 projects in the radial direction from the outer peripheral surface of the hammer case 13. The rotation stopper 97 plays a role of preventing the hammer case 13 from rotating relative to the motor case 12.

A speed reducer 33 is provided in the hammer case 13. The speed reducer 33 is arranged around the axis A1. The speed reducer 33 is arranged between the bearing 19 and the anvil 27 in the direction along the axis A1. The speed reducer 33 is a power transmission apparatus transmitting torque of the electric motor 16 to the anvil 27. The speed reducer 33 is constituted by a single-pinion planetary gear mechanism.

The speed reducer 33 includes a sun gear 34 arranged to be concentric with the output shaft 17, a ring gear 35 provided to surround the outer periphery of the sun gear 34, and a carrier 37 supporting a plurality of pinion gears 36 meshed with the sun gear 34 and the ring gear 35 such that each pinion gear 36 can rotate on the axis of the pinion gear 36 and revolve around the sun gear 34. The sun gear 34 is formed on the outer peripheral surface of an intermediate shaft 38, and the intermediate shaft 38 rotates integrally with the output shaft 17. The ring gear 35 is fixed to the partition 25 and does not rotate. The carrier 37 is rotatably supported by a bearing 39. The bearing 39 is supported by the partition 25.

In addition, the spindle 40 integrally rotating with the carrier 37 around the axis A1 is provided in the hammer case 13. The spindle 40 is arranged between the anvil 27 and the bearing 39 in the direction along the axis A1. A support hole 41 is formed at an end portion of the spindle 40 in the direction along the axis A1. The support shaft 31 is inserted into the support hole 41, and the spindle 40 and the anvil 27 can rotate relative to each other. Two V-shaped cam grooves 42 are provided on the outer peripheral surface of the spindle 40.

In addition, a hammer 43 is accommodated in the hammer case 13. The hammer 43 has a ring shape and includes a shaft hole 44. The spindle 40 is arranged in the shaft hole 44. The hammer 43 is arranged between the speed reducer 33 and the anvil 27 in the direction along the axis A1. The hammer 43 can rotate relative to the spindle 40 around the axis and can move in the direction along the axis A1.

Two cam grooves 46 are formed on the inner peripheral surface of the hammer 43. The two cam grooves 46 are arranged in different ranges in the circumferential direction of the hammer 43 around the axis A1. A ball 47 is held by a set of one cam groove 42 and one cam groove 46. Therefore, the hammer 43 can move along the axis A1 within a range where the balls 47 can roll relative to the spindle 40 and the anvil 27. In addition, the hammer 43 can rotate within a range where the balls 47 can roll relative to the spindle 40.

Furthermore, a hammer spring 49 is arranged inside the hammer case 13. In addition, a ring-shaped plate 50 is attached to an outer periphery of the spindle 40, and an end portion of the hammer spring 49 is in contact with the plate 50. The hammer spring 49 is arranged between the plate 50 and the hammer 43 in a state where a load in the direction along the axis A1 is applied to the hammer spring 49. A pressing force of the hammer spring 49 is applied to the hammer 43, and the hammer 43 is pressed toward the anvil 27 in the direction along the axis A1.

Furthermore, a plurality of projections 51 projecting in the direction along the axis A1 are provided at an end portion of the hammer 43 on a side closer to the anvil 27. An impact mechanism 96 is constituted by the anvil 27, the hammer 43, the spindle 40, and the balls 47. The impact mechanism 96 is a mechanism converting the torque of the electric motor 16 into an impact force in the rotation direction to the anvil 27. The impact mechanism 96 is accommodated in the hammer case 13. Oil for cooling or lubricating the impact mechanism 96 and the speed reducer 33 is contained in the hammer case 13.

The trigger 73 is provided on the grip 14. The trigger 73 can be operated in the direction along the axis A1. An operator applies an operating force to the trigger 73 with a finger. The trigger 73 is arranged within an arrangement range of the hammer case 13 in the direction along the axis A1. In addition, the trigger 73 is arranged between the anvil 27 and the speed reducer 33 in the direction along the axis A1. The trigger 73 is arranged outside the hammer case 13 in the radial direction of the axis A1.

A switch case 114 is provided inside the grip 14, and a trigger switch 80 is accommodated in the switch case 114. The trigger switch 80 is turned ON when an operation force is applied to the trigger 73, and the trigger switch 80 is turned OFF when the operation force applied to the trigger 73 is released. The trigger switch 80 is arranged in a range different from an arrangement range of the trigger 73 in the direction along the axis A1. The arrangement range of the trigger 73 and an arrangement range of the trigger switch 80 overlap with each other in the radial direction around the axis A1. The arrangement range of the trigger switch 80 overlaps with arrangement ranges of the speed reducer 33 and the partition 25 in the direction along the axis A1.

A rotation direction switchover lever 72 is provided between the trigger switch 80 and the trigger 73 provided at the extension portion 12D, and the hammer case 13. The rotation direction switchover lever 72 is operated by an operator in order to switch between normal rotation and reverse rotation of the rotor 21 of the electric motor 16. The wall 81 is arranged between the hammer case 13 and the rotation direction switchover lever 72 in the radial direction of the axis A1. The rotation stopper 97 projects in the radial direction from the outer peripheral surface of the hammer 43 toward the wall 81.

Furthermore, an illumination apparatus 82 is provided inside the extension portion 12D, that is, between the wall 81 and the hammer case 13 in the radial direction of the hammer case 13 around the axis A1. The illumination apparatus 82 is supported by the extension portion 12D. The illumination apparatus 82 includes a light emitting diode (LED) lamp attached to a substrate. In addition, an electric wire 83 applying a voltage to the illumination apparatus 82 is provided. The electric wire 83 passes between the wall 81 and the hammer case 13 inside the extension portion 12D and is arranged inside the grip 14.

Next, a cooling mechanism cooling an inside of the housing 11 will be described. A cooling fan 84 is provided inside the motor case 12. The cooling fan 84 is arranged between the partition 25 and the electric motor 16 in the direction along the axis A1. The cooling fan 84 rotates in conjunction with rotation of the electric motor 16. That is, the cooling fan 84 integrally rotates with the output shaft 17 to form an air flow. Furthermore, a vent 85 is provided in the wall 12B of the motor case 12, and a vent 86 is provided in the cylindrical portion 12A. The vent 86 is arranged between the vent 85 and the electric motor 16 in the direction along the axis A1. The vents 35 and 86 communicate with the inside and the outside of the motor case 12.

Furthermore, a vent 87 penetrating the cylindrical portion 12A in the radial direction is provided. The vent 87 is arranged on a side opposite to a location where the illumination apparatus 82 is arranged in the circumferential direction of the cylindrical portion 12A. That is, the vent 87 is arranged in a portion 12C of the motor case 12 farthest from the grip 14 in the circumferential direction. An arrangement range of the vent 87 in the direction along the axis A1 overlaps with an arrangement range of the cooling fan 34. The vent 87 communicates with the inside and the outside of the motor case 12. The portion 12C is an end portion of the motor case 12, located opposite to the grip 14 with respect to the axis A1 in a front view of the impact work machine 10 illustrated in FIG. 2.

Furthermore, a rib 150 is provided across the range where the cooling fan 84 and the hammer case 13 are arranged in the direction along the axis A1 in the motor case 12. The rib 150 is provided between the cooling fan 84 and the hammer case 13, and the switch case 114 and the wall 81 in the radial direction around the axis A1. The rib 150 includes a first configuration portion 151 arranged along the radial direction outside the cooling fan 84, and a second portion 152 continuous with the first configuration portion 151 and arranged in the direction along the axis A1. A passage 89 is formed between the second portion and the wall 81 inside the extension portion 12D. The rib 150 guides air discharged from the cooling fan 84 toward the passage 89.

That is, the passage 89 is formed between the hammer case 13 and the wall 81 in the radial direction of the hammer case 13. The passage 89 communicates with a space where the cooling fan 84 is arranged. A predetermined range of the hammer case 13 in the circumferential direction is covered with the extension portion 12D. The predetermined range of the hammer case 13 covered with the extension portion 12D is at least a range on a lower side with respect to the axis A1 in FIG. 1. In addition, the passage 89 is formed between a portion 13B located opposite to the portion 13A in the circumferential direction of the hammer case 13, and the wail 81, inside the extension portion 12D. The portion 13B is located lower than the portion 13A in FIG. 2. In addition, the passage 89 is formed between the illumination apparatus 82 and the hammer case 13.

The switch case 114 is exposed to the passage 89. The rotation stopper 97 is provided at the portion 13B in the extension portion 12D and is arranged in the passage 89. A vent 92 is provided at an end of the passage 89 in the direction along the axis A1. The vent 92 is located between the nose cover 93 and the projection 32 in the direction along the axis A1.

Figure 3:
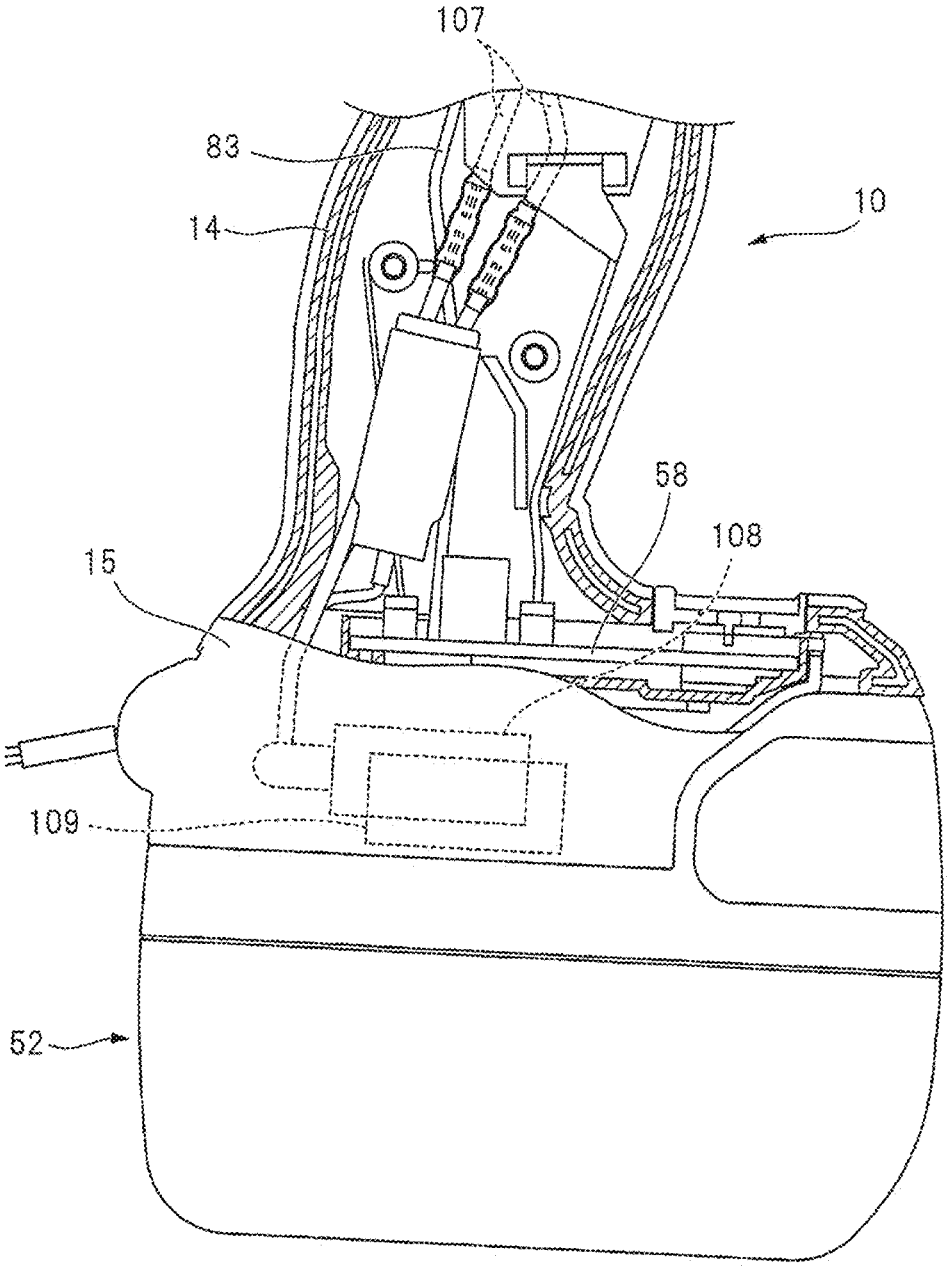
FIG. 3 is a cross-sectional view illustrating a structural example of a grip and an attachment portion of the impact work machine illustrated in FIG. 2.

Next, a control system of the electric motor 16 in the impact work machine 10 will be described with reference to FIGS. 3 and 4. A body-side terminal 108 is provided in the attachment portion 15. A storage battery 52 attached to and detached from the attachment portion 15 is provided. The storage battery 52 includes an accommodation case, and a plurality of battery cells accommodated in the accommodation case. The battery cell is a secondary battery capable of charging and discharging. A lithium-ion battery, a nickel-metal hydride battery, a lithium-ion polymer battery, a nickel-cadmium battery, or the like can be used as the battery cell. The storage battery 52 is a Direct Current (DC) power supply. The storage battery 52 includes a battery-side terminal 109 connected to an electrode of the battery cell. When the storage battery 52 is attached to the attachment portion 15, the body-side terminal 108 and the battery-side terminal 109 are connected to each other.

An inverter circuit 55 is provided in a path through which current of the storage battery 52 is supplied to the electric motor 16. The inverter circuit 55 includes six three-phase bridge-connected switching devices Q1 to Q6 each of which includes a field effect transistor (FET) In the example illustrated in FIG. 4, the switching devices Q1 to Q3 are connected to a positive-electrode side of the storage battery 52, and the switching devices Q4 to Q6 are connected to a negative-electrode side of the storage battery 52. An inverter circuit board 56 is provided between the bearing 18 and the electric motor 16, and the inverter circuit 55 is provided on the inverter circuit board 56. As illustrated in FIG. 2, the inverter circuit board 56 is arranged in the motor accommodation chamber 88. The inverter circuit board 56 is arranged between the electric motor 16 and the wall 12B in the direction along the axis A1. A shaft hole 56A penetrating the inverter circuit board 56 in a thickness direction is provided, and the output shaft 17 can rotate in the shaft hole 56A. An electric wire 107 connecting the inverter circuit 55 and the body-side terminal 108 is arranged to extend from the motor accommodation chamber 88 to the inside of the grip 14.

In addition, rotor position detection sensors 57 detecting a rotation position of the rotor 21 are provided on the inverter circuit board 56. Each rotor position detection sensor 57 is constituted by a Hall IC. The rotor position detection sensors 57 are arranged on the inverter circuit board 56 at predetermined intervals in a peripheral direction of the rotor 21. For example, three rotor position detection sensors 57 are arranged at an angle of 60 degrees apart from one another. The rotor position detection sensors 57 are arranged on a side facing the electric motor 16. Each of the three rotor position detection sensors 57 detects a magnetic field formed by the permanent magnets 24 and outputs a signal corresponding to a detection result. Note that the switching devices Q1 to Q6 are arranged at locations facing the wall 12B on the inverter circuit board 56.

In addition, a control circuit hoard 58 is provided in the attachment portion 15. A motor control unit 59 is provided on the control circuit board 58. The motor control unit 59 includes an arithmetic operation unit 60, a control signal output circuit 61, a motor current detection circuit 62, a battery voltage detection circuit 63, a rotor position detection circuit 64, a motor rotation speed detection circuit 65, a control circuit voltage detection circuit 66, a switch operation detection circuit 67, and an applied voltage setting circuit 68.

A signal output from the rotor position detection sensor 57 is input to the rotor position detection circuit 64. The rotor position detection circuit 64 detects a rotation phase of the rotor 21. A signal output from the rotor position detection circuit 64 is input to the arithmetic operation unit 60. The arithmetic operation unit 60 is a microcomputer including a central processing unit (CPU) which outputs a drive signal for the inverter circuit 55 according to a processing program and data, a ROM for storing the processing program and control data, and a RAM for temporarily storing data.

A resistor Rs is arranged on a path for supplying electric power from the storage battery 52 to the inverter circuit 55. The motor current detection circuit 62 detects a value of a current to be supplied to the electric motor 16 from voltage drop of the resistor Rs and outputs a detection signal to the arithmetic operation unit 60. The battery voltage detection circuit 63 detects the voltage supplied from the storage battery 52 to the inverter circuit 55 and outputs a detection signal to the arithmetic operation unit 60.

The rotor position detection circuit 64 receives an output signal of each rotor position detection sensor 57 and outputs a position signal of the rotor 21 to the arithmetic operation unit 60 and the motor rotation speed detection circuit 65. The motor rotation speed detection circuit 65 detects the rotation speed of the rotor 21 from the input position signal and outputs the detection result to the arithmetic operation unit 60. The voltage of the storage battery 52 is supplied at a predetermined voltage value to the entirety of the motor control unit 59 via the control circuit voltage supply circuit 69. In addition, the control circuit voltage detection circuit 66 detects the value of the voltage supplied from the control circuit voltage supply circuit 69 to the motor control unit 59 and outputs the detection result to the arithmetic operation unit 60.

In addition, a tactile switch 71 is provided on an outer surface of the attachment portion 15, and an operator operates the tactile switch 71, selects a mode, and sets a target rotation speed of the electric motor 16. A mode setting a target rotation speed of the electric motor 16 can be switched over among three stages, that is, a low-speed mode, a middle-speed mode, and a high-speed mode, for example. A target rotation speed set at the middle-speed mode is higher than a target rotation speed set at the low-speed mode. A target rotation speed set at the high-speed mode is higher than the target rotation speed set at the middle-speed mode. A target rotation speed set through operation of the tactile switch 71 is detected by the switch operation detection circuit 67, and a signal output from the switch operation detection circuit 67 is input to the arithmetic operation unit 60. Furthermore, the applied voltage setting circuit 68 sets a voltage to be applied to the electric motor 16 according to the target rotation speed and inputs a signal to the arithmetic operation unit 60. Furthermore, a signal output from the rotation direction switchover lever 72 and a signal output from the trigger switch 80 are input to the arithmetic operation unit 60.

The arithmetic operation unit 60 determines the directions of currents supplied to the coils 23U, 23V, and 23W of the electric motor 16, ON/OFF timing of each of the switching devices Q1 to Q6 of the inverter circuit 55, and a duty ratio as an ON ratio of each of the switching devices Q1 to Q6, according to signals input from various circuits and various switches, and outputs a control signal to the control signal output circuit 61.

The arithmetic operation unit 60 generates drive signals for performing switching control of alternately turning ON or OFF the predetermined switching devices Q1 to Q3, and a pulse width modulation signal for performing switching control of each of the predetermined switching devices Q4 to Q6, according to a position detection signal of the rotor position detection circuit 64 during rotation of the rotor 21, and outputs the signals to the control signal output circuit 61.

According to the drive signals from the arithmetic operation unit 60, the control signal output circuit 61 outputs a switching device drive signal to a gate of the switching device Q1, outputs a switching device drive signal to a gate of the switching device Q2, outputs a switching device drive signal to a gate of the switching device Q3, outputs a pulse width modulation signal to a gate of the switching device Q4, outputs a pulse width modulation signal to a gate of the switching device Q5, and outputs a pulse width modulation signal to a gate of the switching device Q6. That is, the three switching devices Q1 to Q3 are separately turned ON or OFF by switching, device drive signals, the three switching devices Q4 to Q6 are separately turned ON or OFF by pulse width modulation signals, and the duty ratios, which are ON ratios of the switching devices, are controlled.

Due to the above-described control, a current is alternately applied to the coils 23U, 23V, and 23W in a predetermined current application direction, at predetermined current application timing, and for a predetermined period, and the rotor 21 is rotated in a target rotation direction and at a target rotation speed. An operator operates the rotation direction switchover lever 72 to set the target rotation direction. An operator operates the tactile switch 71 to set the target rotation speed.

Due to the above control, the drains or the sources of the six switching devices Q1 to Q6 are separately connected to or disconnected from the star-connected coils 23U, 23V, and 23W. A voltage applied to the inverter circuit 55 is supplied as a voltage Vu corresponding to a U-phase to the coil 23U, is supplied as a voltage Vv corresponding to a V-phase to the coil 23V, and is supplied as a voltage Vw corresponding to a W-phase to the coil 23W. In addition, the arithmetic operation unit 60 changes the pulse width, that is, the duty ratio of a Pulse Width Modulation (PWM) signal according to the target rotation speed.

In addition, the arithmetic operation unit 50 detects actual rotation speed of the rotor 21 according to a signal input from the motor rotation speed detection circuit 65. Then, the arithmetic operation unit 60 controls the duty ratio of the pulse width modulation signal, and controls the rotation speed according to an operation amount of the trigger 73. Feedback control is performed such that the actual rotation speed of the rotor 21 is brought close to the target rotation speed set by the tactile switch 71 when the operation amount of the trigger 73 is greatest. Note that, when the operation force of the trigger 73 is released, the trigger switch 80 is turned OFF. Then, the switching devices Q1 to Q6 of the inverter circuit 55 are kept OFF, no current is supplied to the coils 23U, 23V, and 23W, and the rotor 21 is stopped.

Furthermore, a voltage supply circuit 95 for the illumination apparatus applying the voltage of the storage battery 52 to the illumination apparatus 82 is provided. According to a signal output from the arithmetic operation unit 60, the voltage supply circuit 95 for the illumination apparatus is controlled, and the illumination apparatus 82 is switched between ON and OFF. When the trigger switch 80 is turned ON, the illumination apparatus 82 is switched ON. When the trigger switch 80 is turned OFF, the illumination apparatus 82 is switched OFF.

Next, a usage example of the impact work machine 10 will be described. When the trigger switch 80 is turned ON and the rotor 21 of the electric motor 16 rotates, torque of the output shaft 17 is transmitted to the sun gear 34 of the speed reducer 33. When the torque is transmitted to the sun gear 34, the ring gear 35 becomes a reaction component, and the carrier 37 becomes an output component. That is, when torque of the sun gear 34 is transmitted to the carrier 37, torque is amplified since the rotation speed of the carrier 37 is reduced relative to the rotation speed of the sun gear 34.

When the torque is transmitted to the carrier 37, the spindle 40 integrally rotates with the carrier 37, and the torque of the spindle 40 is transmitted to the hammer 43 via the balls 47. Then, the projections 51 and the projections 32 are engaged with each other, and the torque of the hammer 43 is transmitted to the anvil 27. The hammer 43 and the anvil 27 integrally rotate, and the torque of the anvil 27 is transmitted to the driver bit 29, and a fastening member is fastened.

Then, when fastening of the fastening member is continued and torque necessary for rotating the driver bit 29 is increased, the rotation speed of the spindle 40 becomes higher than the rotation speed of the hammer 43, and the spindle 40 rotates relative to the hammer 43. When the spindle 40 rotates relative to the hammer 43, due to a reaction force generated at a contact surface between the ball 47 and the cam groove 46, the hammer 43 moves away from the anvil 27 in the direction along the axis A1 against a pressing force of the hammer spring 49. Movement of the hammer 43 in a direction away from the anvil 27 is referred to as backward movement. When the hammer 43 moves backward, a compressive load received by the hammer spring 49 increases, and the pressing force of the hammer spring 49 increases.

When the hammer 43 moves backward and the projection 51 is separated from the projection 32, the torque of the hammer 43 is no longer transmitted to the anvil 27, and the hammer 43 rotates together with the spindle 40. Therefore, the projection 51 gets over the projection 32. At a time point when the projection 51 gets over the projection 32, the pressing force applied by the hammer spring 49 to the hammer 43 exceeds a force in a direction of causing the hammer 43 to move backward. Then, the ball 47 rolls along the cam grooves 42 and 46, and thus, the hammer 43 rotates relative to the spindle 40 and the hammer 43 moves in a direction of approaching the anvil 27. Movement of the hammer 43 in the direction of approaching the anvil 27 is referred to as forward movement. Then, the projection 51 of the hammer 43 collides with the projection 32 of the anvil 27, and an impact force in the rotation direction is applied to the anvil 27. Thereafter, while the output shaft 17 is rotating, the above action is repeated, and fastening work of the fastening member is continued.

In addition, while the trigger switch 80 is turned ON, the voltage of the storage battery 52 is applied to the illumination apparatus 82, and the illumination apparatus 82 is switched ON to illuminate a forward area of the anvil 27. Furthermore, when the rotation direction of the rotor 21 is switched over through operation of the rotation direction switchover lever 72, the driver bit 29 rotates in a reverse direction, and the fastening member can be loosened.

Furthermore, when the torque of the rotor 21 is transmitted to the cooling fan 84, the cooling fan 84 rotates and forms an air flow. Specifically, air outside the housing 11 is sucked into the motor accommodation chamber 88 via the vents 85 and 86. The air sucked into the motor accommodation chamber 88 takes heat from each of the switching devices Q1 to Q6 provided on the inverter circuit board 56 and the electric motor 16, and the air flows along the front surface of the hammer case 13 while passing through the passage 89 to be discharged to the outside of the housing 11 via the vent 92.

After the electric motor 16 has been cooled by air flowing inside the motor case 12, the air flows along the hammer case 13, and thus, the speed reducer 33 and the impact mechanism 96 are cooled. Here, since the temperature of the impact mechanism 96 is higher than the temperature of the electric motor 16, cooling efficiency of the impact mechanism 96 is preferable. Furthermore, air flowing through the passage 89 and inside the hammer case 13 takes heat from the hammer 43. Furthermore, some of the heat of the hammer case 13 is transmitted from the portion 13A exposed from the motor case 12 to air outside the housing 11. In addition, some of the heat of the hammer case 13 is transmitted to air in the passage 89 via the rotation stopper 97. Therefore, the cooling property of the hammer case 13 is improved. The hammer case 13 is integrally provided with the rotation stopper 97, which makes the surface area of the hammer case 13 as large as possible. The rotation stopper 97 is arranged in the passage 89. Therefore, the cooling effect of the hammer case 13 can be further improved.

Furthermore, heat of a portion of the hammer case 13, covered with the motor case 12, for example, the portion 13B close to the wall 81 is likely to remain inside the motor case 12; however, the heat is transmitted to air in the passage 89. Therefore, the cooling property of the hammer case 13 is improved. Furthermore, air flowing through the passage 89 cools the illumination apparatus 82. Furthermore, some of the air flowing through the passage 89 flows into the grip 14 and cools the trigger switch 80.

Furthermore, air discharged through the vent 92 is discharged toward the forward area of the anvil 27, and foreign matter can be removed from a working spot. Therefore, foreign matter in the working spot can be prevented from entering the housing 11. Furthermore, air discharged through the vent 92 is discharged toward the forward area of the anvil 27. Therefore, warm air is prevented from being discharged toward an operator. Furthermore, both the hammer case 13 and the wall 81 are fixed to the motor case 12 and do not rotate. Therefore, it is possible to efficiently guide air flowing through the passage 89 to a heat generating section, thereby preventing cooling performance from lowering.

In addition, in the impact work machine 10 illustrated in FIG. 2, air outside the motor case 12 passes through the vents 85 and 86 and enters the motor case 12 to be discharged outside the motor case 12 thereafter. Here, the inverter circuit board 56 is arranged upstream of the electric motor 16 in an air-flow direction inside the motor case 12. Therefore, the inverter circuit board 56 can be cooled by fresh air before the air takes heat from the electric motor 16. Furthermore, the hammer case 13 is arranged downstream of the electric motor 16 in the air-flow direction inside the motor case 12.

In addition, the passage 89 is arranged between the wall 81 and the hammer case 13 in the radial direction around the axis A1. Furthermore, the illumination apparatus 82 is arranged between the trigger 73 73 and the hammer case 13 in the circumferential direction of the hammer case 13. Therefore, it is possible to make a center height H1 from the axis A1 to the portion 12C in the radial direction around the axis A1 as small as possible. The center height H1 is the distance from the axis A1 to the portion 12C located uppermost in the housing 11 in FIG. 1.

Figure 5:
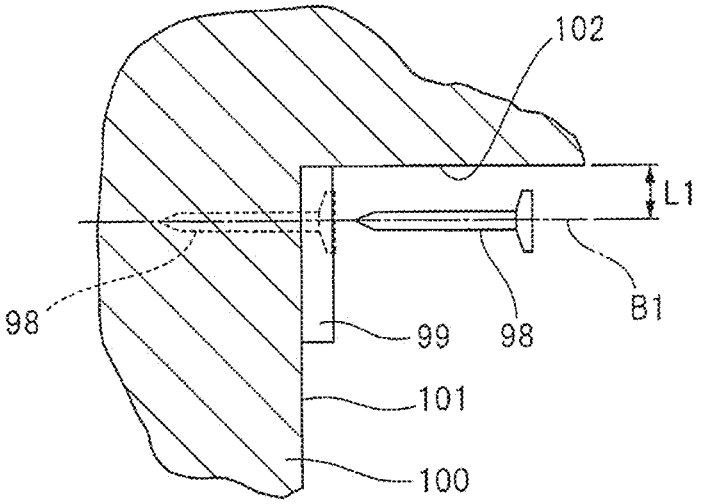
FIG. 5 is a cross-sectional view illustrating work of fastening a screw member by the impact work machine according to the present invention.

As described in FIG. 5, an article 99 can be fixed to a first front surface 101 of a target object 100 with a screw member 98 by using the impact work machine 10. A distance L1 between a front second surface 102 perpendicular to the first front surface 101 and an axis B1 of the screw member 98 can be made as small as possible. When the distance L1 is greater than the center height fastening work of the screw member 98 can be performed without bringing the portion 12C into contact with the second front surface 102.

Figure 6:
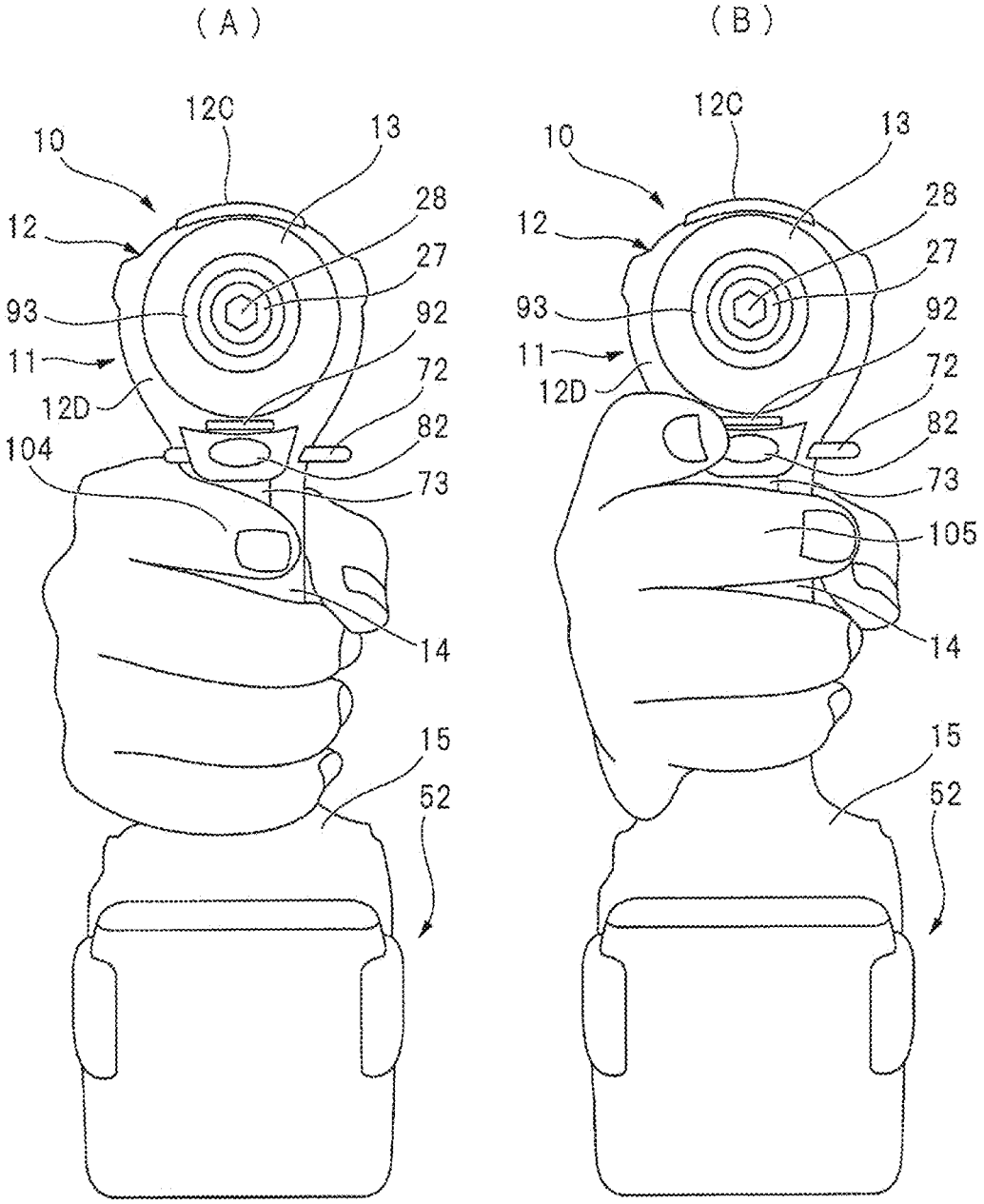
FIGS. 6A and 6B are side views of the impact work machine according to the present invention, each illustrating a manner of gripping the grip of the impact work machine.

FIGS. 6A and 6B are side views of the impact work machine 10 each illustrating an example where an operator grips the grip 14 of the impact work machine 10 with a hand. In FIG. 6A, the trigger 73 is operated with an index finger 104. In FIG. 6B, the trigger 73 is operated with a middle finger 105. Even if the trigger 73 is operated with either the index finger 104 or the middle finger 105, the vent 92 is not blocked by the index finger 104 or the middle finger 105. Therefore, action of discharging air from the vent 92 is not hindered.

Also, a space for providing the electric wire 83 of the illumination apparatus 82 and the rotation direction switchover lever 72 is required between the trigger 73 and the hammer case 13 in the circumferential direction of the hammer case 13. Furthermore, the space also serves as a place where the index finger is placed when the trigger 73 is operated with the middle finger 105. Therefore, by providing the passage 89 in this space, the space can be effectively used. Furthermore, it is not necessary to separately provide a passage in a right-left direction of the hammer 43 in FIG. 6, and to separately provide a passage between the upper side of the hammer case 13 and the housing 11 in FIG. 2. Therefore, an increase in size of the impact work machine 10 can be suppressed.

Figure 7:
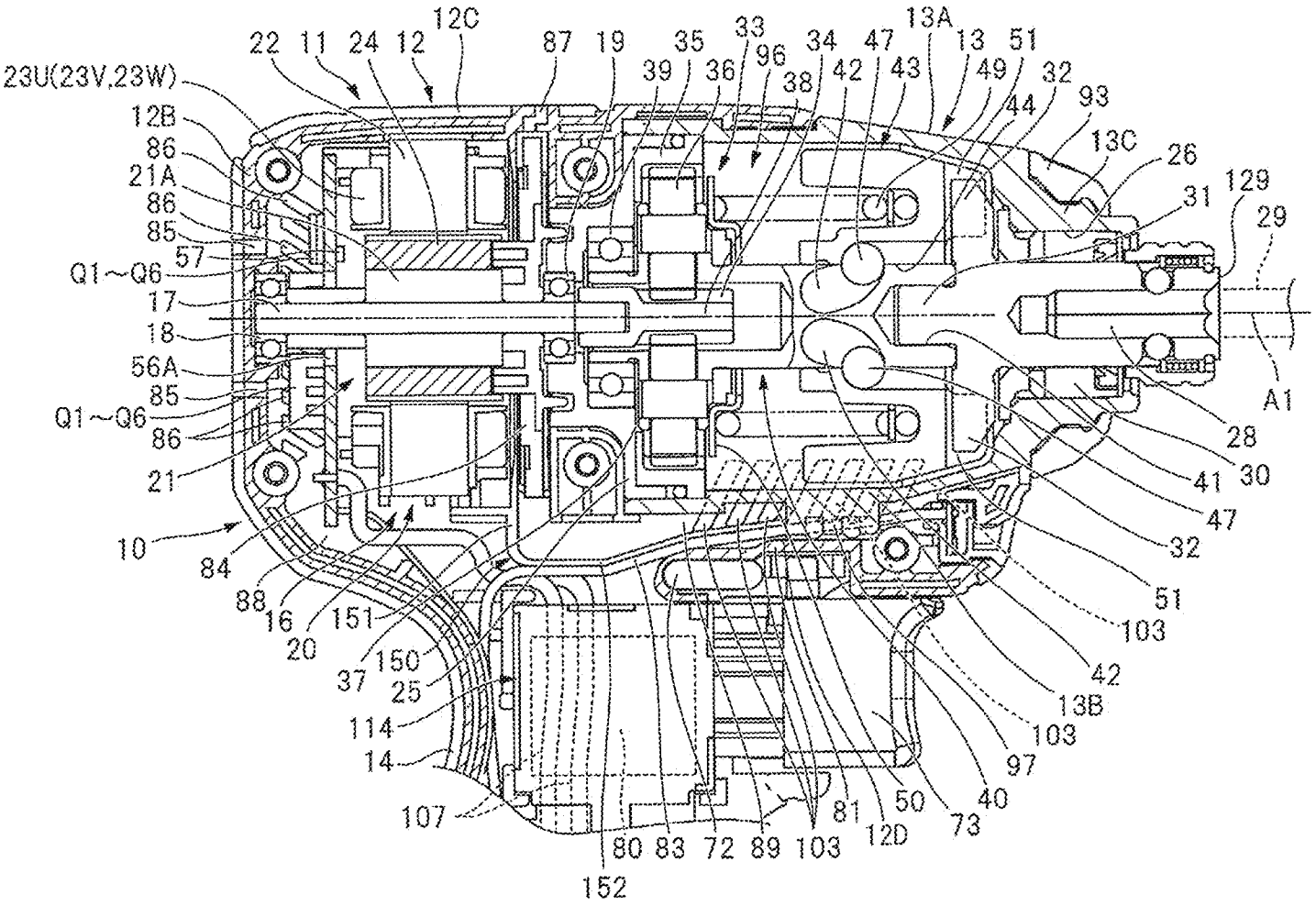
FIG. 7 is a cross-sectional view illustrating another structural example of the impact work machine according to the present invention.

Next, another structural example of the impact work machine 10 will be described with reference to FIG. 7. In FIG. 7, structural portions identical to those in FIG. 2 are denoted by reference characters identical to those in FIG. 2. An impact work machine 10 illustrated in FIG. 7 does not include the vent 92 in FIG. 2. The impact work machine 10 illustrated in FIG. 7 includes a vent 103 penetrating a cylindrical portion 12A. The vent 103 is provided in a range overlapping with an arrangement position of a portion 133 of a hammer case 13 and an arrangement position of a rotation stopper 97 in a front view of the impact work machine 10. The vent 103 communicates with a passage 89. That is, the vent 103 communicates with the inside and the outside of a motor case 12.

In the impact work machine 10 illustrated in FIG. 7, configurations identical to those in the impact work machine 10 in FIG. 2 can obtain actions and effects identical to those of the impact work machine 10 in FIG. 2. In addition, in the impact work machine 10 in FIG. 7, air flowing into the passage 89 is discharged outside a housing 11 from the vent 103. Therefore, foreign matter is prevented from entering the housing 11, for example, the passage 89, through the vent 103. In the impact work machine 10 illustrated in FIG. 7, structures identical to those in the impact work machine 10 in FIG. 2 can obtain actions and effects identical to those of the impact work machine 10 in FIG. 2. The impact work machine 10 in FIG. 7 uses the control system in FIG. 4.

Next, another structural example of the cooling mechanism of the impact work machine 10 will be described with reference to FIG. and 7 are denoted by reference characters identical to those in FIGS. 2 and 7. An impact work machine 10 illustrated in FIG. 8 does not include the vent 92 illustrated in FIG. 2. The impact work machine 10 illustrated in FIG. 8 includes a vent 106 penetrating a cylindrical portion 12A. The vent 106 is provided in a range overlapping with an arrangement position of a cooling fan 84 in a front view of the impact work machine 10. The vent 106 is arranged between a location where a vent 87 is arranged and a location where an illumination apparatus 82 is arranged in the circumferential direction of a motor case 12. The vent 106 communicates with a motor accommodation chamber 88. That is, the vent 106 communicates with the inside and the outside of the motor case 12.

Figure 8:
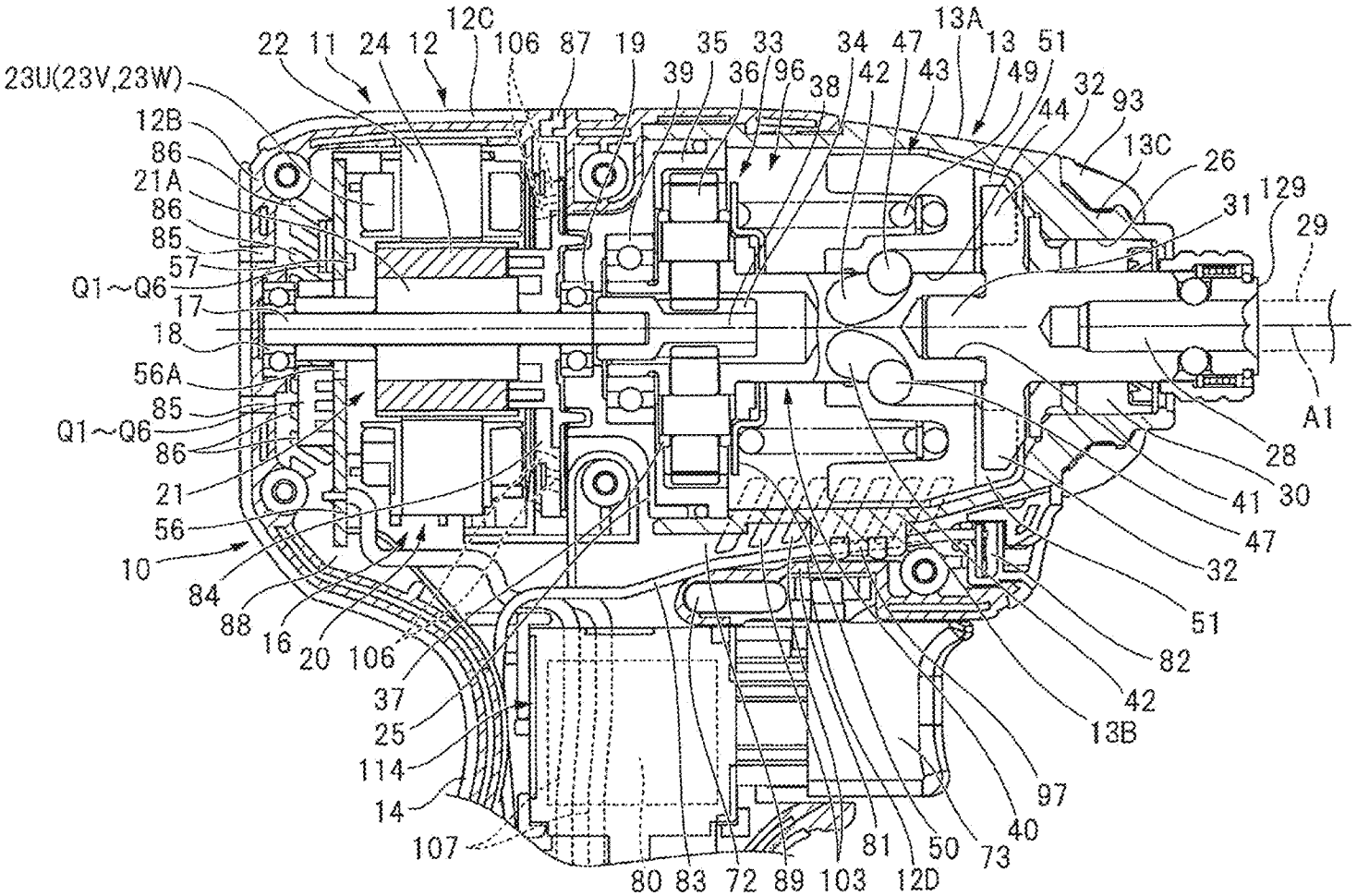
FIG. 8 is a cross-sectional view illustrating still another structural example of the impact work machine according to the present invention.

In the impact work machine 10 illustrated in FIG. 8, structures identical to those in the impact work machines 10 in FIGS. 2 and 7 can obtain actions and effects identical to those of the impact work machines 10 in FIGS. 2 and 7. In addition, in the impact work machine 10 in FIG. 8, when the cooling fan 84 rotates, air outside a housing 11 flows into a passage 89 via a vent 103. The air flowing into the passage 89 takes heat from a hammer case 13, heat from an illumination apparatus 82, and heat from a trigger switch 80. The air in the passage 89 is discharged outside the housing 11 through the vent 106. As described, the hammer case 13, the illumination apparatus 82, and the trigger switch 80 are cooled by air flowing into the passage 89 through the vent 103.

Figure 9:
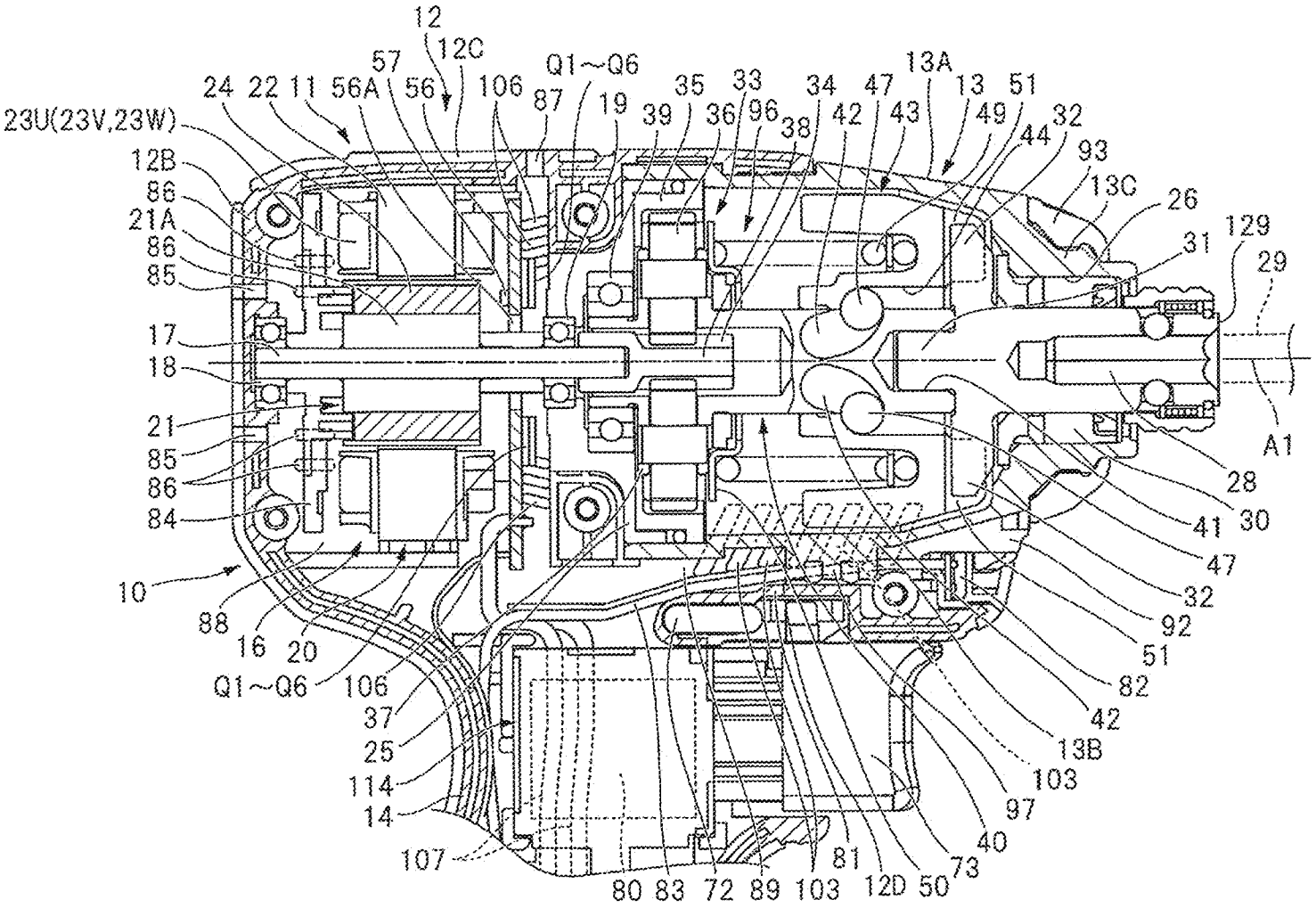
FIG. 9 is a cross-sectional view illustrating vet another structural example of the impact work machine according to the present invention.

Next, another structural example of the cooling mechanism of the impact work machine 10 will be described with reference to FIG. 9. In FIG. 9, structural portions identical to those in FIGS. 2 and 8 are denoted by reference characters identical to those in FIGS. 2 and 8. In an impact work machine 10 illustrated in FIG. 9, a cooling fan 84 is arranged between a wall 12B and an electric motor 16 in a direction along an axis A1. An arrangement position of the cooling fan 84 84 overlaps with an arrangement position of a vent 86 in the direction along the axis A1. Furthermore, an inverter circuit board 56 is arranged between the electric motor 16 and a partition 25 in the direction along the axis A1. That is, when the impact work machine 10 in FIG. 9 and the impact work machine 10 in FIG. 2 are compared to each other, an arrangement position of the inverter circuit board 56 and the arrangement position of the cooling fan 84 are swapped.

Note that, in the inverter circuit board 56, rotor position detection sensors 57 are arranged on the side facing the electric motor 16, and switching devices Q1 to Q6 are arranged on a side facing the partition 25. The side facing the partition 25 is opposite to the side facing the electric motor 16. Furthermore, a motor case 12 includes a vent 106 similarly to FIG, 8, and a passage 89 includes a vent 92.

In the impact work machine 10 in FIG. 9, when the cooling fan 84 rotates together with an output shaft 17 of the electric motor 16, air outside a housing 11 is sucked into the motor case 12 of the housing 11 via the vents 92, 87, 103, and 106. When air sucked into the motor case 12 from the vents 92 and 103 passes through the passage 89, the air takes heat from each of a hammer case 13, an illumination apparatus 82, and a trigger switch 80. Air flowing through the passage 89 and air sucked into the motor case 12 from the vents 87 and 106 take heat from each of the switching devices Q1 to Q6 of the inverter circuit board 56 and take heat from the electric motor 16 to be discharged outside the motor case 12 from the vents 85 and 86. Thus, an impact mechanism 96 and the electric motor 16 are cooled. Note that, in the impact work machine 10 illustrated in FIG. 9, portions with configurations identical to those of the impact work machine 10 in FIG. 2 can obtain actions and effects identical to those of the impact work machine 10 in FIG. 2.

In the impact work machine 10 in FIG. 9, the hammer case 13 is arranged upstream of the electric motor 16 in the air-flow direction inside the motor case 12. Therefore, the hammer case 13 is cooled by fresh air sucked into the motor case 12. In addition, the inverter circuit board 56 is arranged downstream of the electric motor 16 in the air-flow direction inside the motor case 12.

Another structural example of the impact work machine 10 will be described with reference to FIGS. 10 and 11. In an impact work machine 10 illustrated in FIG. 10, configuration portions identical to those of the impact work machine 10 illustrated in FIG. 2 are denoted by reference characters identical to those in FIG. 2. In the impact work machine 10 illustrated in FIG. 10, a wall 111 separating a motor accommodation chamber 88 and a grip 14 is provided inside the motor case 12. In the motor case 12, a passage 112 is provided between the wall 111 and a switch case 114. The passage 112 communicates with a space where a cooling fan 84 is arranged and a passage 89. A control circuit board 58 is arranged not on an attachment portion 15 but in the passage 112. That is, a motor control unit 59 is arranged between an electric motor 16 and a trigger switch 80 in the radial direction around an axis A1. The control circuit board 58 is arranged in parallel to the axis A1 in a front view of the impact work machine 10. Furthermore, a vent 110 is provided at a connection portion between the motor case 12 and the grip 14. The vent 110 communicates with a passage 112. That is, the vent 110 communicates with the inside and the outside of the motor case 12.

Figure 10:
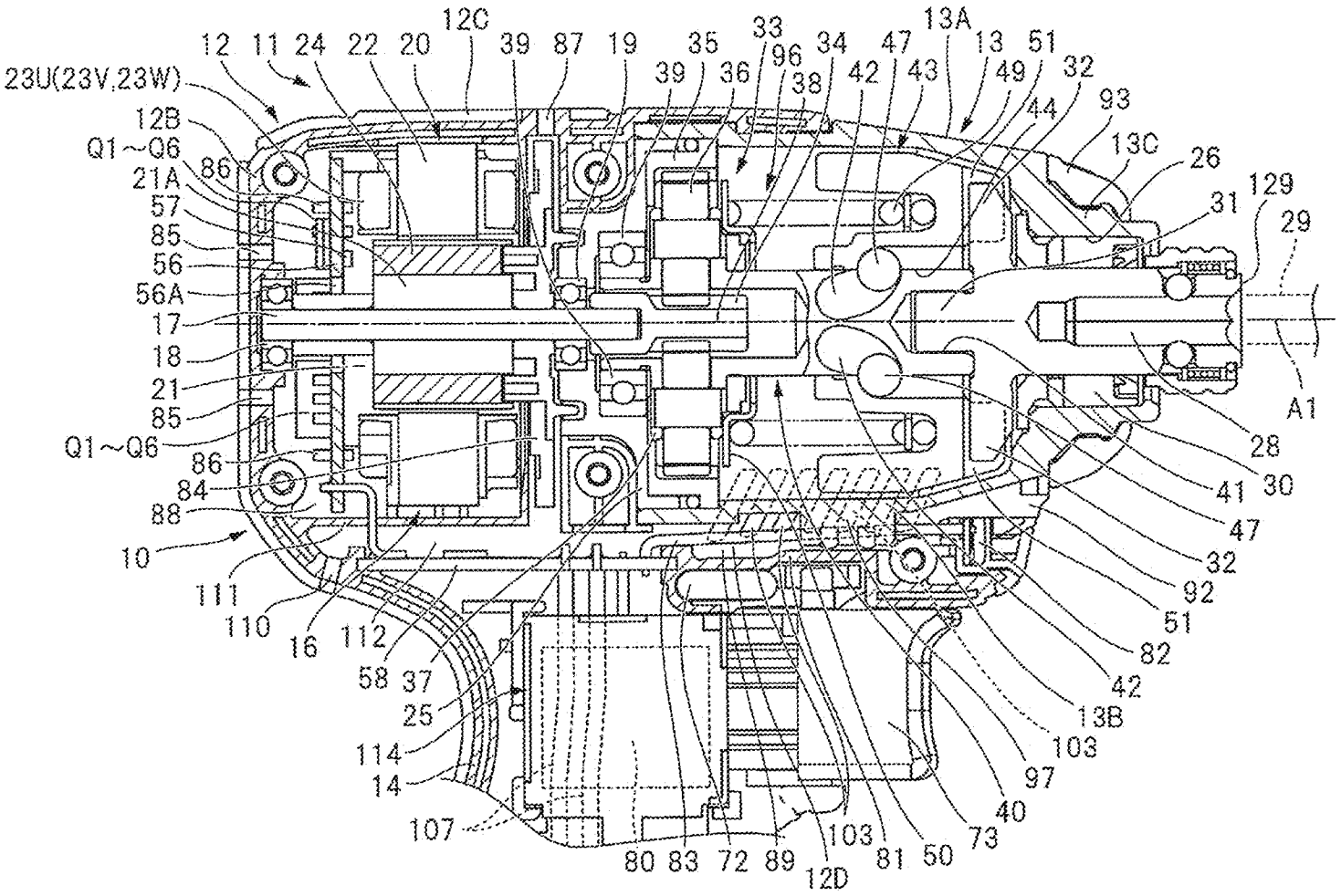
FIG. 10 is a cross-sectional view illustrating further structural example of the impact work machine according to the present invention.
Figure 11:
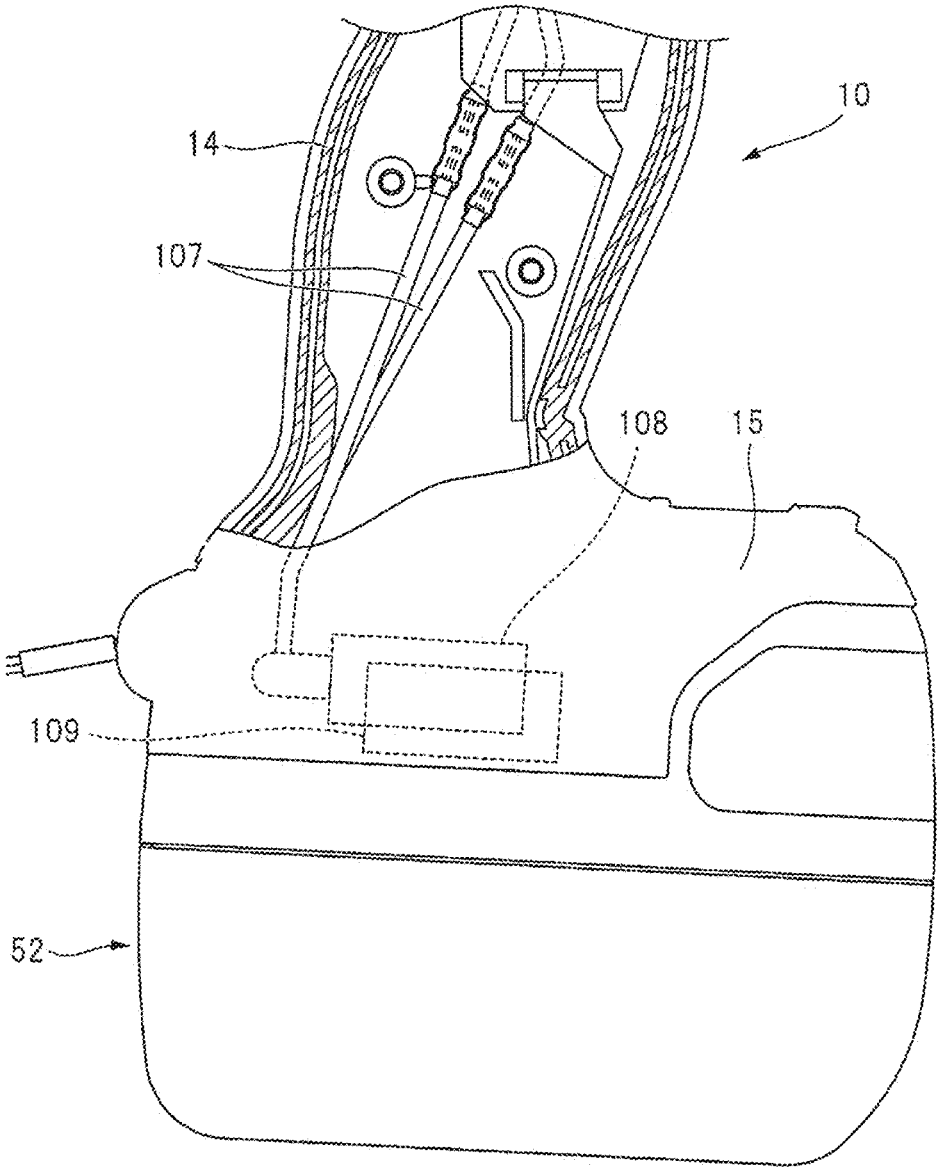
FIG. 11 is a cross-sectional view illustrating a structural example of a grip and an attachment portion of the impact work machine illustrated in FIG. 10.

In the impact work machine 10 in FIG. 10, when the cooling fan 84 rotates together with, an output shaft 17 of the electric motor 16, air outside the housing 11 is sucked into the passage 89 via a vent 92 and a vent 103, and the air sucked into the passage 89 is discharged outside the housing 11 via the passage 112 and the vent 110. When air passes through the passage 89, the air takes heat from each of a hammer case 13, an illumination apparatus 82, and the trigger switch 80. Air flowing through the passage 112 takes heat from each of various circuits provided on the control circuit board 58 to be discharged outside the motor case 12.

Air passing through vents 85 and 86 and then sucked into the motor accommodation chamber 88 takes heat from each of switching devices Q1 to Q6 provided on an inverter circuit board 56 and heat from the electric motor 16 to be discharged outside the housing 11 via a vent 87. As described, the cooling fan 84 rotates to form an air flow, and an impact mechanism 96 and the electric motor 16 are cooled by the air. Note that, in the impact work machine 10 illustrated in FIG. 10, portions with structures identical to those of the impact work machine 10 in FIG. 2 can obtain actions and effects identical to those of the impact work machine 10 in FIG. 2. In addition, the switching devices Q1 to Q6 of the inverter circuit board 56 may be provided on the control circuit board 58, and rotor position detection sensors 57 may be provided on the inverter circuit board 56. In this case, the inverter circuit board 56 is a sensor board.

Another structural example of the impact work machine 10 will be described with reference to FIG. 12. Similarly to the impact work machine 10 illustrated in FIG. 9, in an impact work machine 10 illustrated in FIG. 12, an inverter circuit board 56 is arranged between an electric motor 16 and a partition 25 in the direction along an axis A1. In addition, the cooling fan 84 is arranged between a wall 12B and the electric motor 16 in the direction along the axis A1. A grip 14 and an attachment portion 15 of the impact work machine 10 illustrated in FIG. 12 have structures identical to those illustrated in FIG. 11.

Furthermore, similarly to the impact work machine 10 illustrated in FIG. 9, the impact work machine 10 illustrated in FIG. 12 includes vents 85, 86, 87, and 106, and a passage 89, and further includes a vent 92. In addition, similarly to the impact work machine 10 in FIG. 10, the impact work machine 10 illustrated in FIG. 12 includes a wall 111 and a passage 112, and a control circuit board 58 is arranged in the passage 112.

In the impact work machine 10 in FIG. 12, when the cooling fan 84 rotates together with an output shaft 17, air outside a housing 11 is sucked into a motor case 12 via the vents 87 and 106. In addition, when the cooling fan 84 rotates, air outside the housing 11 passes through the vent 110, flows into the passage 112, and flows into the passage 89 via the vent 92 and a vent 103.

When air passes through the passage 89, the air takes heat from each of a hammer case 13, an illumination apparatus 82, and a trigger switch 80. Air flowing through the passage 112 takes heat from each of various circuits provided on a control circuit board 58. Air having passed through the passages 89 and 112 flows into a motor accommodation chamber 88. In addition, air passing through the vents 87 and 106 and sucked into the motor case 12 cools an inverter circuit 55, and then, the air passes through a shaft hole 56A and takes heat from the electric motor 16. The air having flowed into the motor accommodation chamber 88 passes through the vents 85 and 86 to be discharged outside the housing 11. As described, the cooling fan 84 rotates to form an air flow, and an impact mechanism 96 and the electric motor 16 are cooled by the air. In addition, the various circuits provided on the control circuit board 58 are cooled, and the inverter circuit 55 provided on the inverter circuit board 56 is cooled.

In addition, air passing through the vents 85 and 86 and sucked into the motor accommodation chamber 88 takes heat from the electric motor 16 to be discharged outside the housing 11 through the vent 87. As described, the cooling fan 84 rotates to form an air flow, and the impact mechanism 96 and the electric motor 16 are cooled by the air.

Figure 4:
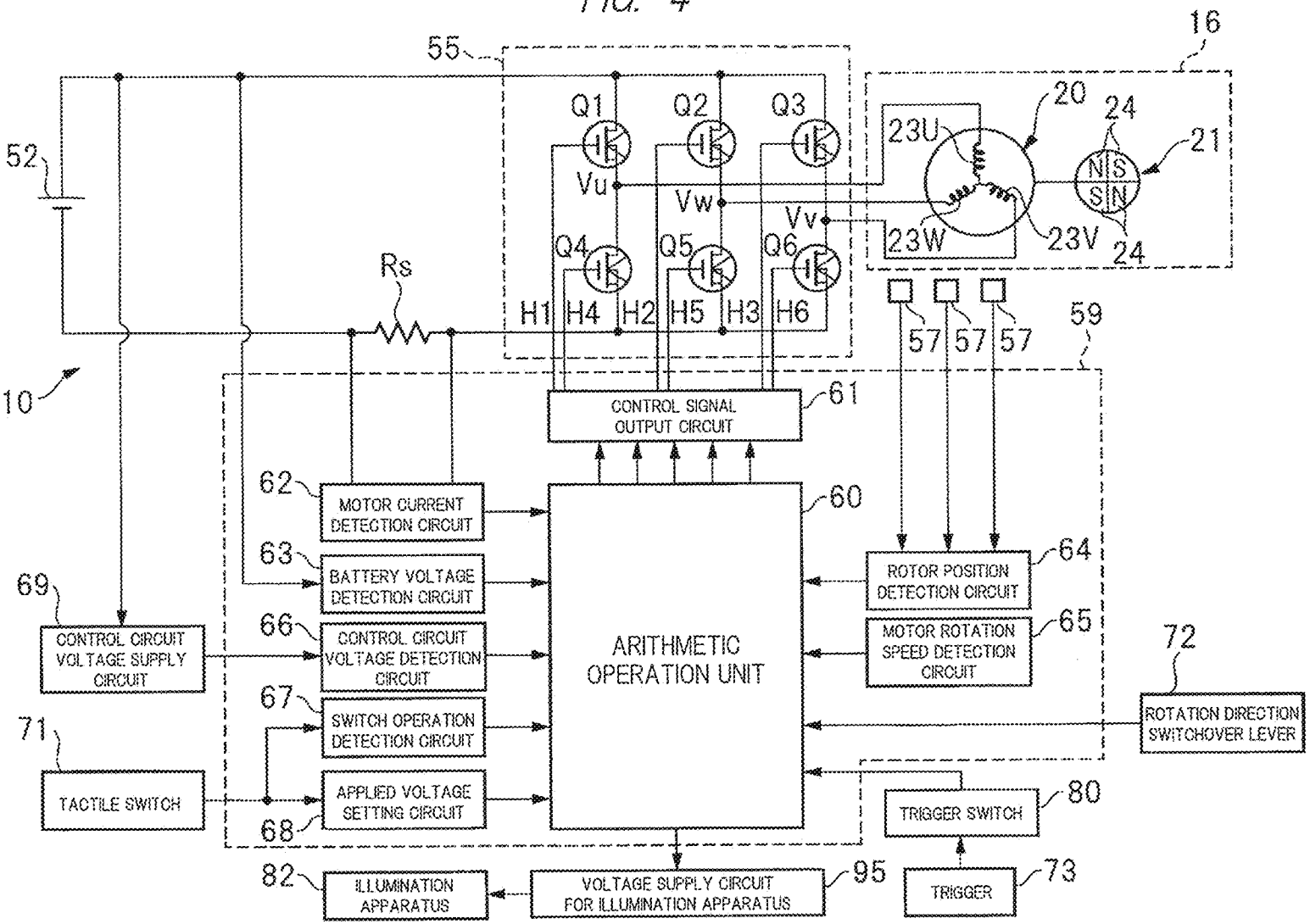
FIG. 4 is a block diagram illustrating a control system of the impact work machine according to the present invention.

The above-described impact work machine 10 has a structure where the switching devices Q1 to Q6 provided in the inverter circuit 55 illustrated in FIG. 4 are turned ON and OFF independently of each other, and a voltage applied to the electric motor is controlled. In contrast, in an impact work machine according to the present invention, instead of a brushless electric motor, an electric motor 16A with a brush can also be used as illustrated in FIG. 13. In this case, a main switch 113 is provided in a circuit supplying current of a storage battery 52 to the electric motor 16A. In this main switch 113, a contact piece 113A mechanically operates in conjunction with operation of a trigger to put contacts 115 and 116 into an ON-state or an OFF-state. The main switch 113 can be arranged in a switch case 114.

Such a configuration enables the main switch 113 to be cooled by air sucked into a motor case. That is, in the case of the brushless motor, the trigger switch 80 is configured to output a control signal to the arithmetic operation unit 60, and since such a large current that flows through the electric motor 16 does not flow through the trigger switch 80, heat is less likely to be generated. In contrast, in the case of the electric motor 16A with a brush illustrated in FIG. 13, the main switch 113 is connected in series to the electric motor 16A, and since large current flowing through the electric motor 16A also flows through the main switch 113, the main switch 113 is likely to generate heat. According to the present invention, a passage through which air passes is provided near the main switch 113 such that the main switch 113 can be cooled, so that the main switch 113 can be effectively cooled.

In the above-described embodiments, the cooling passage is provided on the lower side of the hammer case 13 in each drawing; however, the cooling passage may be provided on a lateral side or above the hammer case 13. In addition, in each of the impact work machines 10 illustrated in FIGS. 7, 8, 9, 10, and 12, the hammer case 13 is cooled by flowing air outside the hammer case 13 without flowing air inside the hammer case 13. That is, the hammer case 13 is not provided with a vent. Therefore, oil or the like inside the hammer case 13 can be prevented from leaking outside the hammer case 13, and the hammer case 13 can be efficiently cooled.

Furthermore, in the impact work machine 10 according to each embodiment, the motor case 12 is cooled by air flowing inside the motor case 12. Furthermore, in the impact work machine 10 according to each embodiment, the electric motor 16, the switching devices Q1 to Q6 of the inverter circuit 55, the speed reducer 33, the impact mechanism 96, the hammer case 13, and the motor case 12 are cooled by air passing through a passage of fresh air passing through the motor case 12, that is, an air path.

Next, another configuration example of the cooling mechanism of the impact work machine 10 will be described with reference to FIGS. 14 to 16. In FIGS. 14 to 16, configuration portions identical to those in FIGS. 1, 2 and 7 are denoted by reference characters identical to those in FIGS. 1, 2 and 7. A bearing 130 is provided to a tool holding hole 28, and the bearing 130 rotatably supports an anvil 27. The impact work machine 10 illustrated in FIGS. 14 to 16 has a protector 120 covering a hammer case 13. The protector 120 covers a portion 13A of the hammer case 13, the portion 13A being exposed to the outside of a motor case 12. The protector 120 is integrally formed of synthetic resin. The protector 120 has a hole 121, and a front end 130 of the hammer case 13 is exposed to the outside of the protector 120 from the hole 121. The protector 120 is brought into contact with an extension portion 12D and a cylindrical portion 12A, and thus, the protector 120 is positioned in the circumferential direction around an axis A1. The protector 120 is brought into contact with the cylindrical portion 12A and the hammer case 13, and thus, the protector 120 is positioned in an axis A1 direction.

Furthermore, a passage 122 is formed between an outer surface of the hammer case 13 and an inner surface of the protector 120. The passage 122 communicates with a passage 89. In addition, the protector 120 has an exhaust port 123. The exhaust port 123 penetrates the protector 120 from the inner surface to the outer surface of the protector 120. That is, the exhaust port 123 penetrates the protector 120 in the thickness direction. The exhaust port 123 communicates with the passage 122. The exhaust port 123 is arranged between the axis A1 and a portion 12C in a front view of the impact work machine 10 illustrated in FIG. 14. The exhaust port 123 is arranged more forward than a speed reducer 33 in the axis A1 direction. Specifically, the exhaust port 123 is arranged between the speed reducer 33 and a projection 32 of the anvil 27 in the axis A1 direction. In addition, the exhaust port 123 is arranged on each side of the axis A1 in plan view of the impact work machine 10.

In the impact work machine 10 illustrated in FIGS. 14 to 16, air sucked into the motor case 12 passes through the passages 89 and 122 and is discharged to the outside of the protector 120 from the exhaust port 123 as illustrated by a broken line in FIG. 15. While the air passes through the passage 122, the air takes heat of the hammer case 13. Therefore, an increase in temperature of the hammer case 13 can be prevented. In addition, the exhaust port 123 is formed between the axis A1 and the portion 12C in the front view of the impact work machine 10 illustrated in FIG. 14, and a trigger 73 is located more downward than the axis A1. Therefore, it is possible to prevent air discharged through the exhaust port 123 from being blown to a finger operating the trigger 73.

In addition, an area of the front surface of the hammer case 13 which is brought into contact with air until the air passing through the passage 89 passes through the passage 122 and is discharged through the exhaust port 123 can be made as large as possible. Therefore, a transmission area of heat transmitted from the hammer case 13 to the air increases, and performance of cooling the hammer case 13 is improved.

Furthermore, in the impact work machine 10 in FIGS. 14 to 16, the protector 120 covers the hammer case 13, and the hammer case 13 is not exposed to the outside. Therefore, it is possible to prevent the hammer case 13 from coming into contact with an object at a work Furthermore, air passing through the passage 122 can flow along the front surface shape of the hammer case 13, the contact area where the hammer case 13 is in contact with the air can be enlarged, and the contact time of the hammer case 13 and the air can be made longer. Thus, performance of cooling the hammer case 13 is improved. Note that, in the impact work machine 10 illustrated in FIGS. 14 to 16, configurations identical to those in the impact work machine 10 in FIGS. 1 and 2 can obtain effects identical to those of the impact work machine 10 illustrated in FIGS. 1 and 2.

Next, another structural example of the cooling mechanism of the impact work machine 10 will be described with reference to FIG. 17. In FIG. 17, structural portions identical to those in FIGS. 1, 2, 7, and 14, 16 are denoted by reference characters identical to those in FIGS. 1, 2, 7, and 14 to 16. A protector 120 has an exhaust port 124 in addition to an exhaust port 123. The exhaust port 124 penetrates the protector 120 in the thickness direction. The exhaust port 124 is arranged between an axis A1 and an extension portion 12D in FIG. 17, which illustrates a front view of the impact work machine 10. The exhaust port 124 is arranged more forward than a speed reducer 33 in the axis A1 direction. Specifically, the exhaust port 124 is arranged between the speed reducer 33 and a projection 32 of an anvil 27 in the axis A1 direction. Each of the exhaust ports 123 and 124 is arranged on each side of the axis A1 in plan view of the impact work machine 10.

In the impact work machine 10 illustrated in FIG. 17, air sucked into a motor case 12 passes through passages 89 and 122 and is discharged outside the protector 120 from both the exhaust ports 123 and 124. While the air passes through the passage 122, the air takes heat of a hammer case 13. Therefore, an increase in temperature of the hammer case 13 can be prevented. In the impact work machine 10 illustrated in FIG. 17, configurations identical to those in the impact work machine 10 in FIGS and 2 and the impact work machine 10 in FIGS. 14 to 16 can obtain effects identical to those of the impact work machine 10 in FIGS. 1 and 2 and the impact work machine 10 in FIGS. 14 to 16.

Next, another structural example of the cooling mechanism of the impact work machine 10 will be described with reference to FIG. 18. In FIG. 18, structural portions identical to those in FIGS. 1, 2, 7, and 14 to 16 are denoted by reference characters identical to those in FIGS. 1, 2, 7, and 14 to 16. An exhaust port 125 is provided between a protector 120 and an extension portion 12D. The exhaust port 125 is a gap formed between an edge 126 of the protector 120 and an edge 127 of the extension portion 12D. The exhaust port 125 communicates with a passage 122. The exhaust port 125 is arranged between an axis A1 and an exhaust port 123 in FIG. 18, which illustrates a front view of the impact work machine 10. The exhaust port 125 is arranged more forward than a speed reducer 33 in the axis A1 direction. Specifically, the exhaust port 125 is arranged between the speed reducer 33 and a projection 32 of an anvil 27 in the axis A1 direction. Each of the exhaust ports 123 and 125 is arranged on each side of the axis A1 in plan view of the impact work machine 10.

In the impact work machine 10 illustrated in FIG. 18, air sucked into a motor case 12 is discharged outside the protector 120 from the exhaust port 125 while the air passes through the passage 122. In the impact work machine 10 illustrated in FIG. 18, configurations identical to those in the impact work machine 10 illustrated in FIGS. 1 and 2 and the impact work machine 10 illustrated in FIGS. 14 to 16 can obtain effects identical to those of the impact work machine 10 illustrated in FIGS. 1 and 2 and the impact work machine 10 illustrated in FIGS. 14 to 16. Note that the exhaust port 125 may be provided in the impact work machine 10 in FIG. 17.

Next, another structural example of the cooling mechanism of the impact work machine 10 will be described with reference to FIG. 19. The cooling mechanism in FIG. 19 can be used for the impact work machine 10 in FIGS. 14 to 16, the impact work machine 10 in FIG. 17, and the impact work machine 10 in FIG. 18. In the impact work machine 10 in FIG. 19, an exhaust port 128 is provided between a protector 120 and a nose cover 93 in the axis A1 direction. The exhaust port 128 communicates with a passage 122 via a hole 121. In addition, the exhaust port 128 communicates with the outside of the nose cover 93 and the protector 120. The exhaust port 128 is a gap formed between an end portion of the protector 120 and an end portion of the nose cover 93. The exhaust port 128 is formed into a ring shape surrounding a front end 13C. The exhaust port 128 is arranged more forward than a speed reducer 33 in the axis A1 direction. Specifically, the exhaust port 128 is arranged between the speed reducer 33 and a front end 129 of an anvil 27 in the axis A1 direction. The front end 129 of the anvil 27 is located at a position opposite to the position where a projection 32 is arranged in the axis A1 direction. The front end 129 is arranged outside a hammer case 13.

In the impact work machine 10 in FIG. 19, air in the passage 122 is discharged outside the protector 120 and the nose cover 93 via the hole 121 and the exhaust port 128. Therefore, an increase in temperature of the hammer case 13 can be prevented. In the impact work machine 10 illustrated in FIG. 19, configurations identical to those in the impact work machine 10 in FIGS. 1 and 2, the impact work machine 10 in FIGS. 14 to 16, the impact work machine 10 in FIG. 17, and the impact work machine 10 in FIG. 18 can obtain effects identical to those of the impact work machine 10 in FIGS. 1 and 2, the impact work machine 10 in FIGS. 14 to 16, the impact work machine 10 in FIG. 17, and the impact work machine 10 in FIG. 18. Note that the exhaust port 128 can be provided in an impact work machine which is not provided with the exhaust port 123 or the exhaust port 124, or in an impact work machine which is not provided with the exhaust Port 125.

Furthermore, the passage 122 and the exhaust port 123 illustrated in FIGS. 14 and 15 can be provided in at least one of the impact work machine 10 in FIG. 2, the impact work machine 10 in FIG. 7, the impact work machine 10 in FIG. 8, the impact work machine 10 in FIG. 9, the impact work machine 10 in FIG. 10, and the impact work machine 10 in FIG. 12.

Furthermore, the passage 122 and the exhaust port 124 illustrated in FIG. 17 can be provided in at least one of the impact work machine 10 in FIG. 2, the impact work machine 10 in FIG. 7, the impact work machine 10 in FIG. 8, the impact work machine 10 in FIG. 9, the impact work machine 10 in FIG. 10, and the impact work machine 10 in FIG. 12.

Furthermore, the passage 122 and the exhaust port 125 illustrated in FIG. 18 can be provided in at least one of the impact work machine 10 in FIG. 2, the impact work machine 10 in FIG. 7, the impact work machine 10 in FIG. 8, the impact work machine 10 in FIG. 9, the impact work machine 10 in FIG. 10, and the impact work machine 10 in FIG. 12.

Furthermore, the passage 122 and the exhaust port 128 illustrated in FIG. 19 can be provided in at least one of the impact work machine 10 in FIG. 2, the impact work machine 10 in FIG. 7, the impact work machine 10 in FIG. 8, the impact work machine 10 in FIG. 9, the impact work machine 10 in FIG. 10, and the impact work machine 10 in FIG. 12.

In the configurations described in the embodiments, the electric motor 16 corresponds to a motor and an electric motor according to the present invention, the anvil 27 corresponds to a tool support member according to the present invention, the impact work machine 10 corresponds to a work machine according to the present invention, and each of the impact mechanism 96 and the speed reducer 33 corresponds to a power transmission apparatus according to the present invention. In addition, the axis A1 corresponds to an axis according to the present invention, the illumination apparatus 82 corresponds to an illumination apparatus according to the present invention, the passage 89 corresponds to a cooling passage according to the present invention, the housing 11 corresponds to a housing according to the present invention, the hammer case 13 corresponds to a hammer case or a case according to the present invention, the speed reducer 33 corresponds to a speed reducer according to the present invention, and the impact mechanism 96 corresponds to the impact mechanism according to the present invention.

Furthermore, the motor case 12 corresponds to a motor case according to the present invention, the motor accommodation chamber 88 corresponds to a motor accommodation chamber according to the present invention, and the extension portion 12D and the wall 81 correspond to an extension portion according to the present invention, and the grip 14 corresponds to a grip according to the present invention. In addition, the portion 13A corresponds to a first portion according to the present invention, the portion 13B corresponds to a second portion according to the present invention, the trigger switch 80 corresponds to a switch according to the present invention, and the cooling fan 84 corresponds to a cooling fan according to the present invention. Furthermore, the motor control unit 59 corresponds to a motor control unit according to the present invention, the rotation stopper 97 corresponds to rotation stopper according to the present invention, and the vent 92 corresponds to an exhaust port according to the present invention, and the wall 12B corresponds to a wall according to the present invention.

Furthermore, the vent 85 corresponds to a first vent according to the present invention, the vent 87 corresponds to a second vent according to the present invention, each of the vents 103 and 106 corresponds to a third vent according to the present invention, the vent 86 corresponds to a fourth vent according to the present invention, the vent 110 corresponds to a fifth vent according to the present invention, the rotation direction switchover lever 72 corresponds to a rotation direction switchover member according to the present invention, and the electric wire 83 corresponds to an electric wire according to the present invention.

The correspondence relation between the configurations described with reference to FIGS. 14 to 19 and the configuration according to the present invention will be described. Each of the exhaust ports 123, 124, 125, and 128 corresponds to an exhaust port according to the present invention, the passage 122 corresponds to a passage according to the present invention, each of the exhaust ports 123 and 124 corresponds to a first exhaust port according to the present invention, the exhaust port 125 corresponds to a second exhaust port according to the present invention, and the exhaust port 128 corresponds to a third exhaust port according to the present invention. Furthermore, the nose cover 93 corresponds to a cover according to the present invention, the portion 12C corresponds to an "end portion of a housing" according to the present invention.

The direction along the axis A1 or the direction parallel to the axis A1 is the front-back direction in the present invention. In addition, an output shaft extending in the front-back direction of the present invention means that the output shaft is arranged along the axis and does not mean that a length of the output shaft changes in the front-back direction. Forward in the present invention means a direction approaching a, target object from the wall 123 along the axis A1. Backward in the present invention is a direction approaching the wall 1213 from the tool support member along the axis A1. A "lower side of the case" in the present invention means a range from the position corresponding to the axis to the portion 133 in the circumferential direction or the radial direction of the hammer case 13 in FIGS. 2, 7, 8, 9, 10, 12, and 15.

Note that a lower side in the present invention means a positional relation in a case where the impact work machine 10 is supported such that the grip 14 is arranged at a position lower than the cylindrical portion 12A as in FIGS. 2, 7, 8, 9, 10, 12, and 15. That is, the "lower side" in the present invention is not limited to a lower side in the gravity acting direction, that is, a vertical direction.

A "position above the switch" in the present invention means the position opposite to the position where the grip is arranged with respect to the switch in the radial direction of the axis. Note that a "position above" in the present invention means a position in a case where the impact work machine 10 is supported such that the grip 14 is arranged at a position lower than the cylindrical portion 12A as in FIGS. 2, 7, 8, 9, 10, 12, 14, 15, and 17. That is, "above" in the present invention is not limited to above in the gravity acting direction, that is, the vertical direction.

It is needless to say that the present invention is not to be limited to the above-described embodiments and may be modified in various ways within a scope not deviating from the gist thereof. For example, in the control circuit illustrated in FIG. 4, it is possible to provide a main switch between the storage battery 52 and the inverter circuit 55. That is, the main switch is provided in addition to the switching devices Q1 to Q6 of the inverter circuit 55. In this main switch, the contact piece mechanically operates in conjunction with operation of the trigger to bring the contacts into an ON-state or an OFF-state.

In addition, an article fixed by the work tool may be anything such as wood, a steel plate, or a signboard. Examples of the work tool include a driver bit fastening or loosening a screw member or a bolt, and a drill bit drilling a target object such as wood or concrete. Furthermore, examples of the power supply supplying a current to the electric motor include an AC power supply in addition to a DC power supply such as a storage battery. In a case where an AC power supply is used as the power supply, the electric motor and the AC power supply are interconnected via an electric cable. Examples of the motor according to the present invention include a hydraulic motor, a pneumatic motor, and an internal combustion engine in addition to the electric motor. In addition, examples of the work machine according to the present invention include a driver or a drill in which a tool support member rotates and impact force in the rotation direction is not applied. Furthermore, examples of the work machine according to the present invention include a hammer in which impact force in the axis direction is applied to a tool support member and torque is not transmitted to the tool support member.

EXPLANATION OF REFERENCE CHARACTERS

10 . . . impact work machine, 11 . . . housing, 12 . . . motor case, 12B . . . wall, 12C . . . portion, 13A, 13B . . . portion, 14 . . . grip, 16 . . . electric motor, 27 . . . anvil, 33 . . . speed reducer, 43 . . . hammer, 59 . . . motor control unit, 72 . . . rotation direction switchover lever, 80 . . . trigger switch, 82 . . . illumination apparatus, 83 . . . electric wire, 84 . . . cooling fan, 85, 86, 87, 103, 106, 110 . . . vent, 88 . . . motoraccommodation chamber, 89, 112 . . . passage,

92 . . . vent, 93 . . . nose cover, 96 . . . impact mechanism, 97 . . . rotation stopper, 123, 124, 125, 128 . . . exhaust port, A1 . . . axis.

The invention claimed is:

1. A work machine comprising:

a motor including an output shaft extending in a front-back direction;

a tool support member to which power of the motor is transmitted;

a housing including a motor case accommodating the motor and a grip extending downwardly from the motor case;

a cooling fan provided in the housing, and rotating in conjunction with rotation of the motor such that air outside the housing is sucked into the housing;

a power transmission apparatus transmitting power of the motor to the tool support member;

a second case located forward of the motor case, nonrotatable relative to the motor case, and accommodating the power transmission apparatus;

an extension portion provided on the housing and extending forwardly from the motor case toward the second case so as to cover at least part of a lower side of the second case;

a protector provided separately from the housing and covering the second case;

a cooling passage provided between an outer surface of the lower side of the second case and the extension portion, wherein air sucked in by the cooling fan passes through the cooling passage; and a second passage formed between the outer surface of the second case and an inner surface of the protector, the second passage communicating with the cooling passage, wherein the air sucked in by the cooling fan flows through the second passage along the outer surface of the second case.

2. The work machine according to claim 1, wherein an exhaust port is provided so as to penetrate the protector in a thickness direction, and the exhaust port allows the air sucked into the housing by the cooling fan and having passed through the cooling passage and the second passage to be discharged outside the protector.

3. The work machine according to claim 2, further comprising a vent provided in the housing, and through which air outside the housing is sucked into the housing, wherein the work machine is configured such that the air sucked into the housing from the vent by the cooling fan passes through the motor case, the cooling passage and the second passage, and is discharged from the exhaust port.

4. The work machine according to claim 1, wherein an exhaust port is provided between the motor case and the protector, and the exhaust port allows the air sucked into the housing by the cooling fan and having passed through the cooling passage and the second passage to be discharged outside the protector.

5. The work machine according to claim 1, wherein an inverter circuit board including an inverter circuit controlling rotation of the motor is provided, and the cooling passage communicates with at least one of a space where the cooling fan is provided and a space where the inverter circuit board is provided.

6. The work machine according to claim 5, wherein the inverter circuit board is arranged upstream of the motor in an air-flow direction in the cooling passage, and the second case is arranged downstream of the motor in the air-flow direction.

7. The work machine according to claim 1, wherein the extension portion is provided with an illumination apparatus illuminating a forward area of the tool support member, the cooling passage is formed between the second case and the illumination apparatus in a radial direction of an axis that is a rotation center of the output shaft, and an electric wire through which electric power is supplied to the illumination apparatus is arranged in the cooling passage.

8. The work machine according to claim 1, wherein the cooling passage is formed between the second case and a wall provided in the extension portion, and the extension portion includes one of:

an exhaust port communicating with inside and outside of the extension portion, and through which the air in the cooling passage is discharged outside the extension portion; and a vent communicating with the inside and outside of the extension portion, and through which the air outside the extension portion is sucked into the cooling passage.

9. A work machine comprising:

a motor including an output shaft extending in a front-back direction;

a tool support member to which power of the motor is transmitted;

a power transmission apparatus transmitting power of the motor to the tool support member;

a case accommodating the power transmission apparatus;

a housing accommodating the motor and the case, and supporting the case such that the case is nonrotatable;

a cooling fan provided in the housing, and rotating in conjunction with rotation of the motor such that air outside the housing is sucked into the housing;

a protector covering a portion of the case that is exposed from the housing;

an exhaust port provided in the protector, and through which the air in the housing is discharged outside the housing; and a passage provided between the case and the protector, and arranged to allow the inside of the housing and the exhaust port to communicate with one another such that the air flows on a surface of the case along a circumferential direction of the case.

10. A work machine comprising:

a motor including an output shaft extending in a front-back direction;

a tool support member to which power of the motor is transmitted;

a power transmission apparatus transmitting power of the motor to the tool support member;

a case accommodating the power transmission apparatus;

a housing accommodating the motor, and supporting the case such that the case is nonrotatable;

a cooling fan provided in the housing, and rotating in conjunction with rotation of the motor such that air outside the housing is sucked into the housing;

a protector covering a portion of the case that is exposed from the housing;

a first passage formed between the housing and the case, communicating with inside and outside of the housing, and through which the air flows; and a cooling passage communicating with the first passage, formed between the case and the protector, and formed such that the air flows on a surface of the case along a circumferential direction of the case.

* * * * *